US009617706B2

(12) United States Patent
Takemura et al.

(10) Patent No.: US 9,617,706 B2
(45) Date of Patent: Apr. 11, 2017

(54) WORKING MACHINE WITH HYDRAULIC HOSE AND BOOM INTERMEDIATE PORTION

(71) Applicant: KUBOTA CORPORATION, Osaka (JP)

(72) Inventors: Toshihiko Takemura, Osaka (JP); Masahiro Kuroda, Osaka (JP); Kenichi Ogura, Osaka (JP); Hayato Ido, Osaka (JP); Shigeki Morishita, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 20 days.

(21) Appl. No.: 14/489,984

(22) Filed: Sep. 18, 2014

(65) Prior Publication Data

US 2015/0132095 A1 May 14, 2015

(30) Foreign Application Priority Data

Nov. 13, 2013 (JP) ..... 2013-234950

(51) Int. Cl.
*E02F 9/22* (2006.01)
*E02F 3/34* (2006.01)
*E02F 3/42* (2006.01)

(52) U.S. Cl.
CPC ..... *E02F 3/3414* (2013.01); *E02F 3/422* (2013.01); *E02F 9/2275* (2013.01)

(58) Field of Classification Search
CPC ..... E02F 3/3414; E02F 9/2275
See application file for complete search history.

(56) References Cited

U.S. PATENT DOCUMENTS 3,776,403 A * 12/1973 Billings ..... E02F 9/2275 414/692
5,807,061 A * 9/1998 Donoghue ..... E02F 3/3414 414/697

FOREIGN PATENT DOCUMENTS

| | | |
|---|---|---|
| JP | 2007-327291 | 12/2007 |
| JP | 2010-059734 | 3/2010 |
| JP | 2013-036258 | 2/2013 |
| JP | 2013-036258 A * | 2/2013 |

* cited by examiner

*Primary Examiner* — Gerald McClain
(74) *Attorney, Agent, or Firm* — Greenblum & Bernstein, P.L.C.

(57) ABSTRACT

Working machine that includes a machine frame, an operator seat, and a boom disposed on each side of the operator seat. The boom includes a boom base portion disposed on a position corresponding to a rear portion of the machine frame. A boom tip end portion is disposed opposite to the boom base portion. A boom intermediate portion is disposed between the boom base portion and the boom tip end portion. A boom cylinder is connected to the boom base portion at one end and to the machine frame at the other end. The boom cylinder is configured to swing the boom upward and downward. A hose insertion hole is disposed in the boom base portion and is opened backward or downward. A hydraulic hose is inserted into the hose insertion hold and is internally disposed in an inside of the boom intermediate portion.

24 Claims, 17 Drawing Sheets

WORKING MACHINE WITH HYDRAULIC HOSE AND BOOM INTERMEDIATE PORTION

CROSS-REFERENCE TO RELATED APPLICATIONS

The present application claims priority under 35 U.S.C. §119 to Japanese Patent Application No. 2013-234950, filed Nov. 13, 2013. The contents of this application are incorporated herein by reference in their entirety.

BACKGROUND ART

Field of the Invention

The present invention relates to a working machine, for example, a skid steer loader, a compact truck loader and the like.

Description of the Related Art

A working machine disclosed in Japanese Unexamined Patent Application Publication No. 2013-36258 is known as a conventional working machine.

The working machine mounts a cabin on a machine frame and equips an operation unit. The operation unit includes: a boom arranged to both of a right side and a left side of the cabin; a bucket provided to tip end sides of the booms arranged to the right side and the left (the right boom and the left boom); lift links and control links supporting a base portion side of each of the right boom and the left boom on the machine frame; boom cylinders lifting and lowering the booms; and bucket cylinders to be driven to swing the bucket. In addition, a hydraulic pressure extraction part for a hydraulic attachment to be attached instead of the bucket is provided to the tip end sides of the booms.

The lift links are arranged approximately vertically at rear end sides of the booms provided to the right side and the left side.

Rear end portions of the booms are each pivotally supported via a pivot by an upper end portion of the lift link. Lower end sides of the lift links are each pivotally supported by the machine frame.

The control links support the base portion sides of the booms so that the right boom and the left boom can swing upward and downward centering around pivots provided to the upper end portions of the lift links.

In addition, the hydraulic pressure extraction part is provided to side surfaces of the booms of the working machine, the side surfaces facing an inward direction along a right to left direction (or along a left to right direction), and a hydraulic pipeline is arranged to the side surfaces along the booms from the rear end sides to front portions of the booms in order to introduce a pressure fluid to a hydraulic actuator of the bucket cylinder and the like, the hydraulic pipeline being constituted of a hydraulic pipe.

SUMMARY OF THE INVENTION

Problems to be Solved by the Invention

In the conventional working machine, the hydraulic pipe is arranged between the cabin and the booms, thereby restricting expansion of a width of a room space of the cabin, the width being along a right to left direction (or along a left to right direction) of the working machine (hereinafter referred to as a right to left width).

Accordingly, in order to ensure the right to left width of the room space of the cabin, it is considered to internally install, in the booms, the hydraulic pipeline arranged along the booms from the rear end sides to the front portions of the booms.

A working machine internally installing the hydraulic hose in the boom is known. The working machine has a hose insertion opening on a side surface facing an inward direction along the right to left direction (or along the left to right direction) in a rear portion of the boom and internally installs the hydraulic hose in the boom by inserting the hydraulic hose from the hose insertion opening into the boom.

When the hydraulic hose is extended toward a front of the boom after insertion of the hydraulic hose from the side surface facing an inward direction along the right to left direction (or along the left to right direction) in the rear portion of the boom, the hydraulic hose is tightly bent. In particular, the boom swings upward and downward centering around a pivot of an upper end portion of a lift link, thereby causing a problem that makes arrangement of the hydraulic hose difficult.

Accordingly, considering the above-mentioned problems, it is an object of the present invention to provide a working machine, the working machine capable of: ensuring the right to left width of the room space of the cabin by internally installing, in the boom, the hydraulic hose arranged from the base portion side of the boom to the tip end portion side of the boom; and making the arrangement of the hydraulic hose easy in internally installing the hydraulic hose in the boom.

Means to Solve the Problems

To solve the above-mentioned technical problems, techniques that the present invention provides are characterized in the following points.

A working machine includes: a machine frame; an operator seat provided to the machine frame; a boom provided on each side of the operator seat; a boom base portion being a part of the boom, the boom base portion being provided to a position corresponding to a rear portion of the machine frame and being pivotally supported to enable the boom to swing upward and downward; a hose insertion hole provided in the boom base portion, the hose insertion hole being opened backward or downward; and a hydraulic hose internally provided into an inside of the boom through the hose insertion hole, the hydraulic hose being used for passage of an operation fluid.

A working machine includes: a machine frame; an operator seat provided to the machine frame; a boom provided on each side of the operator seat; a boom base portion being a part of the boom, the boom base portion being provided to a position corresponding to a rear portion of the machine frame and being pivotally supported to enable the boom to swing upward and downward, the boom base portion having a rear end portion communicated with an inside of the boom; and a hydraulic hose internally provided into an inside of the boom from backward of the boom base portion, the hydraulic hose being used for passage of an operation fluid.

A working machine includes: a machine frame; an operator seat provided on the machine frame; a boom provided on each side of the operator seat; a boom base portion being a part of the boom, the boom base portion being provided to a position corresponding to a rear portion of the machine frame and being pivotally supported to enable the boom to swing upward and downward; and a hydraulic hose internally provided from backward of the boom base portion or from downward of the boom base portion into an inside of the boom, the hydraulic hose being used for passage of an operation fluid.

The working machine described above further includes: a lift link provided to the boom base portion, the lift link being pivotally supported by a first pivot on the boom base portion at one end portion of the lift link, the lift link being pivotally supported by a second pivot on the machine frame at the other end portion of the lift link, the second pivot being provided on a lower side of the first pivot; and a hose guide provided to a side surface of the lift link. The boom swings upward and downward centering around the first pivot, the hydraulic hose is provided along the side surface of the lift link through the hose guide.

The working machine described above further includes: a lift link provided to the boom base portion, the lift link being inserted between an inner side wall and an outer side wall of the boom base portion at one end portion of the lift link, the lift link being pivotally supported by a first pivot on the boom base portion at the one end portion of the lift link, the lift link being pivotally supported by a second pivot on the machine frame at the other end portion of the lift link, the second pivot being provided on a lower side of the first pivot. The boom base portion includes the inner side wall, the outer side wall opposite to the inner side wall, an upper connection wall connecting upper portions of the inner side wall and the outer side wall, and a lower connection wall connecting lower portions opposite to the upper portions of the inner side wall and the outer side wall, the hose insertion hole is formed of the inner side wall, the outer side wall, the upper connection wall, and the lower connection wall and is configured by opening between an end of a rear portion of the upper connection wall and an end of a rear portion of the lower connection wall, the boom swings upward and downward centering around the first pivot, and a plurality of the hydraulic hoses pass through between the lift link and the inner side wall and between the lift link or the outer side wall, and are provided into the hose insertion hole.

The working machine described above further includes: a lift link provided to the boom base portion, the lift link being inserted between an inner side wall and an outer side wall of the boom base portion at one end portion of the lift link, the lift link being pivotally supported by a first pivot on the boom base portion at the one end portion of the lift link, the lift link being pivotally supported by a second pivot on the machine frame at the other end portion of the lift link, the second pivot being arranged on a lower side of the first pivot. The boom base portion includes the inner side wall, the outer side wall opposite to the inner side wall, an upper connection wall connecting upper portions of the inner side wall and the outer side wall, and a lower connection wall connecting lower portions opposite to the upper portions of the inner side wall and the outer side wall, the upper connection wall and the lower connection wall provide a space opened between rear portions thereof, the boom swings upward and downward centering around the first pivot, and a plurality of the hydraulic hoses pass through, in front of the first pivot, between the lift link and the inner side wall and between the lift link and the outer side wall, and are provided into the space opened between the rear portions of the upper connection wall and the lower connection wall.

The working machine described above further includes: a lift link provided to the boom base portion, the lift link being inserted between an inner side wall and an outer side wall of the boom base portion at one end portion of the lift link, the lift link being pivotally supported by a first pivot on the boom base portion at the one end portion of the lift link, the lift link being pivotally supported by a second pivot on the machine frame at the other end portion of the lift link, the second pivot being arranged on a lower side of the first pivot. The boom base portion includes the inner side wall, the outer side wall opposite to the inner side wall, an upper connection wall connecting upper portions of the inner side wall and the outer side wall, and a lower connection wall connecting lower portions opposite to the upper portions of the inner side wall and the outer side wall, the upper connection wall and the lower connection wall provide a space opened backward or downward between rear portions thereof, the boom swings upward and downward centering around the first pivot, and a plurality of the hydraulic hoses pass through, in front of the first pivot, between the lift link and the inner side wall and between the lift link and the outer side wall, and are provided into the space opened backward or downward between the rear portion of the upper connection wall and the rear portion of the lower connection wall.

In the working machine described above, a clearance between the lift link and the outer side wall is larger than a clearance between the lift link and the inner side wall, or the clearance between the lift link and the inner side wall is larger than the clearance between the lift link and the outer side wall.

In the working machine described above, a clearance between the lift link and the outer side wall is larger than a clearance between the lift link and the inner side wall, a plurality of the hydraulic hoses includes a first hydraulic hose and a second hydraulic hose having a diameter smaller than a diameter of the first hydraulic hose, the first hydraulic hose passes through between the lift link and the outer side wall, and the second hydraulic hose passes through between the lift link and the inner side wall.

The working machine described above further includes: a hydraulic coupler. The boom has an upper surface, the upper surface facing upward, the hydraulic coupler is provided to a front end portion of the upper surface of the boom, and an end portion of the hydraulic hose is withdrawn from the upper surface of the boom to be connected to the hydraulic coupler.

The working machine described above further includes: a bucket provided to a tip end portion of the configured to move the bucket; a bucket cylinder pin configured to connect an upper end portion of the bucket cylinder to the boom; a hydraulic coupler provided to the boom; and a hose outlet hole communicated with the hydraulic coupler and passing the hydraulic hose through the hose outlet hole, the hose outlet hole being provided posterior to the bucket cylinder pin and opened upward.

The working machine described above further includes: a lift link provided to the boom base portion; and a control link provided anterior to the lift link to the boom base portion. The lift link is pivotally supported by a first pivot on the boom base portion at one end portion of the lift link, the lift link is pivotally supported by a second pivot on the machine frame at the other end portion of the lift link, the control link is pivotally supported by a third pivot on the machine frame at one end portion of the control link, the control link is pivotally supported by a fourth pivot on the boom base portion at the other end portion of the control link, and the boon swings upward and downward centering around the first pivot.

Effects of the Invention

According to the present invention, the following effects are provided.

A right to left width, the right to left width being a width along a right to left direction (or along a left to right direction) of a working machine, of a room space of a cabin can be ensured by internally installing, in a boom, a hydraulic hose arranged from a base portion side of the boom to a tip portion side of the boom. In addition, the hydraulic hose is internally installed by being inserted from a lower side of the base portion of the boom into the boom through a hose insertion opening that opens backward, thereby internally installing the hydraulic hose in the boom. Accordingly, the hydraulic hose can be inserted smoothly into the boom, the boom being to swing upward and downward centering around a first pivot as a fulcrum, the first pivot being positioned at a rear portion side of the boom, and arrangement of the hydraulic hose can be easy.

Additionally, a hose guide is provided to a side surface of a lift link, the hose guide regulating a move of the hydraulic hose in a right direction and a left direction with a move of the hydraulic hose allowed in a longitudinal direction of the hydraulic hose, thereby the hydraulic hose can smoothly follow a move of the boom swinging upward and downward around the pivot provided to the rear end side of the boom.

Moreover, the hydraulic hose can be arranged on a surface provided along a vertical direction in internally installing the hydraulic hose in the boom by inserting the hydraulic hose into the boom from the lower side of the base portion of the boom through the hose insertion opening, thereby giving advantage in internally installing the hydraulic hose in the boom being to swing upward and downward centering around the first pivot as a fulcrum, the first pivot being positioned at the rear portion side of the boom base portion.

Furthermore, a path of arrangement of: a large-diameter hydraulic hose; and a small-diameter hydraulic hose having a diameter smaller than that of the large-diameter hydraulic hose can be ensured well by forming one of: a clearance of a gap between the lift link and an inner wall of the base portion of the boom; and a clearance of a gap between the lift link and an outer wall of the base portion of the boom to be greater than the other.

In addition, an exit for the hose is provided to and a hydraulic coupler for extraction of a hydraulic pressure is installed to the tip end side of an upper surface of the boom, thereby an end portion of the hydraulic hose, the end portion being on the tip end side of the boom, can be smoothly drawn, and thereby reducing a possibility to damage the hydraulic coupler, the damage being caused when the hydraulic coupler hits to something in an operation of the working machine.

DESCRIPTION OF THE EMBODIMENTS

Referring to drawings, an embodiment of the present invention will be described below.

Figure 1:
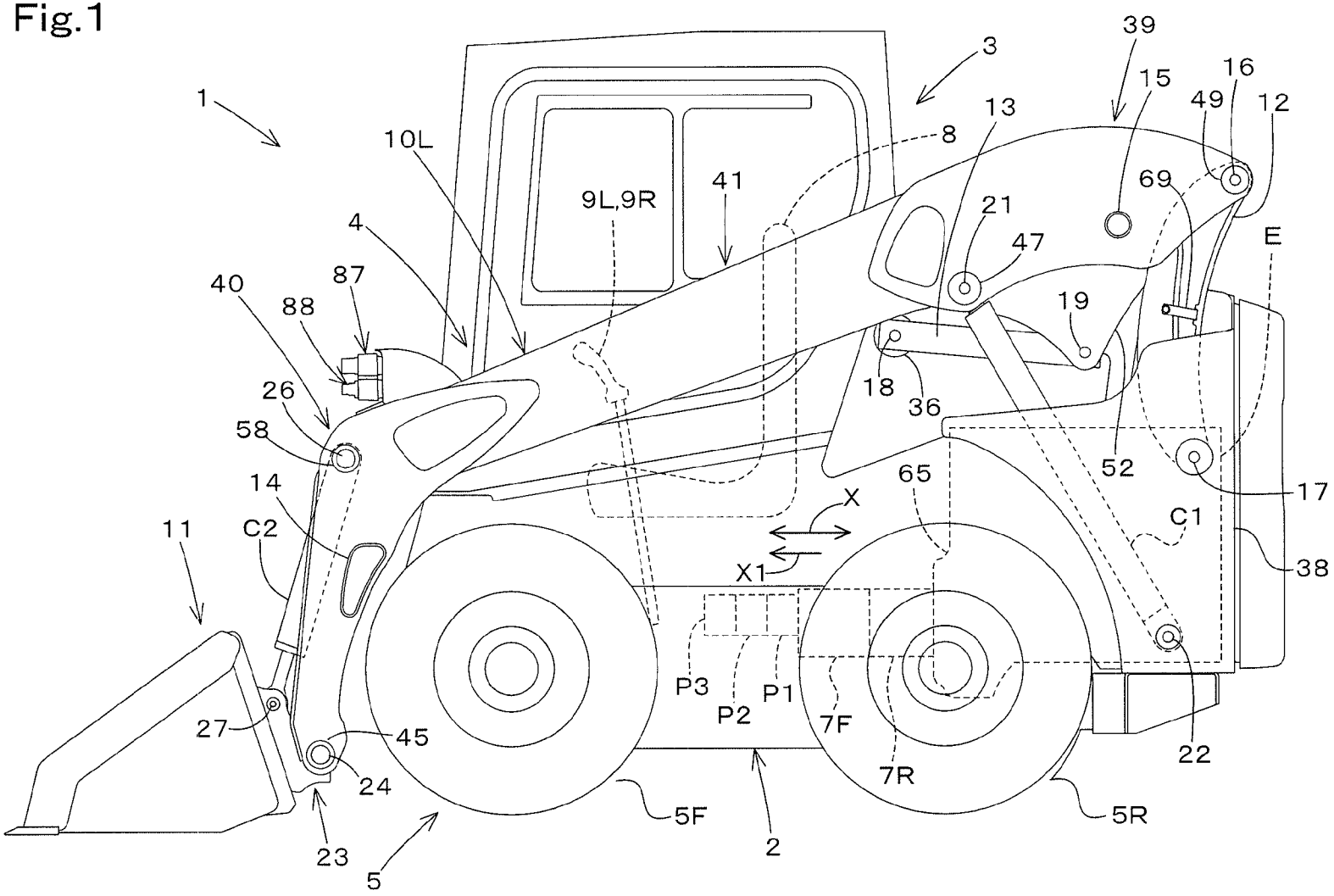
FIG. 1 is a side view of a skid steer loader.
Figure 2:
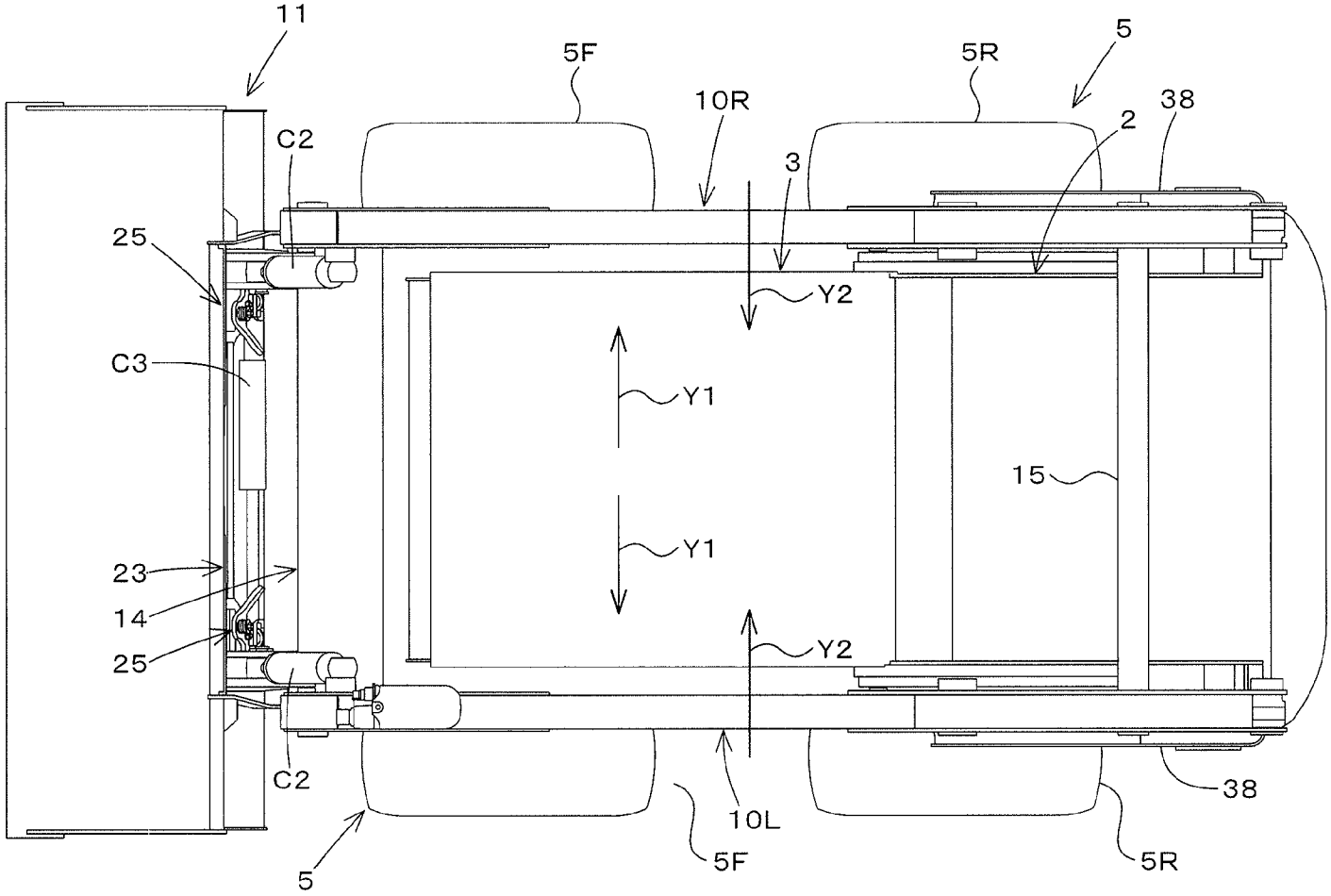
FIG. 2 is a plan view of the skid steer loader.

FIG. 1 shows a side view of a skid steer loader 1 exemplified as a working machine. FIG. 2 shows a plan view of the skid steer loader 1.

In the following description, an outward direction along a right to left direction (or along a left to right direction) is a direction toward an end portion in a right to left direction (or in a left to right direction) of the skid steer loader 1 from a center portion in the right to left direction (that is a direction shown by an arrowed line Y1 in FIG. 2), the right to left direction (or the left to right direction) being a horizontal direction perpendicular to a direction toward a rear portion of a machine frame 2 described later from a front portion of the machine frame 2, hereinafter the direction being referred to as an "R to L outward". In addition, an inward direction along a right to left direction (or along a left to right direction) is a direction toward the center portion in the right to left direction of the skid steer loader 1 from the end portion in the right to left direction (that is a direction shown by an arrowed line Y2 in FIG. 2), hereinafter the direction being referred to as an "R to L inward".

In FIG. 1 and FIG. 2, the skid steer loader 1 has the machine frame 2, a cabin 3, an operation unit 4, and a travel unit 5.

The cabin 3 is mounted on the machine frame 2. The operation unit 4 is equipped to the machine frame 2. The travel unit 5 is provided to each of a right side and a left side (one side portion in the horizontal direction and the other side portion opposed to the one side portion) of the machine frame 2.

An engine 6 is mounted on a rear portion on the machine frame 2. A pump housing 65 is provided to a front surface side of the engine 6. The pump housing 65 is provided with a pair of HST pumps 7F and 7R, the HST pumps being to drive the travel unit 5. The pair of the HST pumps 7F and 7R is arranged in parallel along a front to rear direction X. A first pump P1, a second pump P2, and a third pump P3 are provided along the front to rear direction X in front (a direction indicated by a reference numeral "X1") of the HST pump 7F provided to the front side. These pumps, the HST pumps 7F and 7R and the first to third pumps P1, P2, and P3, are driven by the engine 6.

The HST pump 7F provided to the front side (hereinafter also referred to as the front HST pump 7F) and the HST pump 7R provided to the rear side (hereinafter also referred to as the rear HST pump 7R), constitute a part of a hydrostatic continuously variable transmission (an HST) for driving the travel unit 5 provided to the right (hereinafter also referred to as the right travel unit 5) and the travel unit 5 provided to the left (hereinafter also referred to as the left travel unit 5). The front HST pump 7F and the rear HST pump 7R are each constituted of hydraulic pump of a variable displacement type, the hydraulic pump employing a swash plate.

The HST is provided to each of the right travel unit 5 and the left travel unit 5. The HST is capable of changing a revolution speed (for example, revolutions per minute) and a revolution direction of an output shaft, the output shaft being a component of a motor constituting a part of the HST, by changing a tilt angle of the swash plate included in each of the HST pumps 7F and 7R.

The front HST pump 7F drives the left travel unit 5. The rear HST pump 7R drives the right travel unit 5.

The first pump P1, the second pump P2, and the third pump P3 are each constituted of a gear pump of a constant displacement type. The first pump P1 is used for driving a hydraulic actuator provided to the operation unit 4 and for driving a hydraulic actuator provided to a hydraulic attachment, the hydraulic attachment being attached to the operation unit 4. The second pump P2 is used for increasing (additionally supplying) the hydraulic operation fluid. The third pump P3 is used for mainly supplying a pressure of a control signal.

An operator seat 8 is provided to a rear portion in a room of the cabin 3. A pair of a left travel lever 9L (a travel lever 9L) and a right travel lever 9R (a travel lever 9R) is provided in front of the operator seat 8, the left travel lever 9L and the right travel lever 9R each being used for operation of the travel unit 5. The travel lever 9L provided to the left side of the operator seat 8 is a member used for operation of the travel unit 5 provided to the left side (the front HST pump 7F) of the machine frame 2. The travel lever 9R provided to the right side of the operator seat 8 is a member used for operation of the travel unit 5 provided to the right side (the rear HST pump 7R) of the machine frame 2.

The operation unit 4 has a right boom 10R (a boom 10R), a left boom 10L (a boom 10L), a bucket 11 (a work tool), a lift link 12, a control link 13, a boom cylinder C1, and a bucket cylinder C2. The right boom 10R is arranged on the right sides of the cabin 3 and the machine frame 2. And, the left boom 10L is arranged on the left sides of the cabin 3 and the machine frame 2. The bucket 11 is provided to tip sides (front end sides) of the right boom 10R and the left boom 10L, and is thereby capable of freely swinging upward and downward. The lift link 12 and the control link 13 support base portion sides (rear portion sides) of the booms 10R and 10L. The boom cylinder C1 lifts and lowers the booms 10L and 10R. The bucket cylinder C2 swings the bucket 11. The boom cylinder C1 and the bucket cylinder C2 are each composed of a double-acting hydraulic cylinder.

The tip sides of the right boom 10R and the left boom 10L are connected each other with a front connection member 14 formed of a deformed pipe. The base portion sides of the right boom 10R and the left boom 10L are connected each other with a rear connection member 15 formed of a circular pipe. The lift link 12, the control link 13, and the boom cylinder C1 are provided, corresponding to the right boom 10R and the left boom 10L, to each of the right side and the left side of the machine frame 2.

The lift links 12 are arranged approximately vertically at rear end sides of the booms 10R and 10L. Upper end sides of the lift links 12 are pivotally supported via pivots 16 (hereinafter each referred to as a first pivot) by the rear end sides of the base portions of the booms 10R and 10L, thereby being freely rotatable centering around an axis extending along the right to left direction (or along the left to right direction). In addition, lower end sides of the lift links 12 are pivotally supported via pivots 17 (hereinafter each referred to as a second pivot) by an upper portion of the rear end side of the machine frame 2, thereby being freely rotatable centering around the axis extending along the right to left direction (or along the left to right direction).

The control links 13 are arranged in front of the lift links 12. The control links 13 are arranged along the front to rear direction. Front end sides of the control links 13 are pivotally supported via pivots 18 (hereinafter each referred to as a third pivot) by the machine frame 2, thereby being freely rotatable centering around the axis extending along the right to left direction (or along the left to right direction). Rear end sides of the control links 13 are pivotally supported via pivots 19 (hereinafter each referred to as a fourth pivot) by lower end portions at an intermediate positions in the front to rear direction, the intermediate positions being closer to the base portion sides of the booms 10R and 10L than the tip sides, thereby being freely rotatable centering around the axis extending along the right to left direction (or along the left to right direction).

Upper portions of the boom cylinders C1 are pivotally supported via first boom cylinder pins 21 by front portions of the base portion sides of the booms 10R and 10L, thereby being freely rotatable centering around the axis extending along the right to left direction (or along the left to right direction). Lower portions of the boom cylinders C1 are pivotally supported via second boom cylinder pins 22 by a lower portion of the rear end side of the machine frame 2, thereby being freely rotatable centering around the axis extending along the right to left direction (or along the left to right direction).

When the boom cylinders C1 are stretched and shortened, the tip sides (the bucket 11) of the booms 10R and 10L are lifted and lowered with the base portion sides of the booms 10R and 10L supported by the lift links 12 and the control links 13; in this manner, the booms 10R and 10L swing upward and downward centering around the first pivots 16.

The control links 13 swing upward and downward centering around the third pivots 18 in synchronization with the upward and downward swinging of the booms 10R and 10L. The lift links 12 swing forward and backward centering around the second pivots 17 in synchronization with the upward and downward swinging of the control links 13.

The bucket 11 is attached to an attachment 23 in a freely attachable and detachable manner, the attachment 23 being pivotally supported by the tip sides (the front end sides) of the right boom 10R and the left boom 10L. The attachment 23 is pivotally supported via a pivotally-supporting pin 24 by the tip sides of the right boom 10R and the left boom 10L, thereby being capable of freely swinging centering around the axis extending along the right to left direction (or along the left to right direction). A hydraulic attachment such as a hydraulic crusher, a hydraulic breaker, an angle broom, an earth auger, a pallet fork, a sweeper, a mower, and a snow blower can be attached to the attachment 23 instead of the bucket 11. In addition, the attachment 23 has a lock mechanism 25 for preventing the bucket 11 from dropping. Operations to lock and to release the locking of the lock mechanism 25 is performed by a lock cylinder C3 constituted of the double-acting hydraulic cylinder.

The bucket cylinders C2 are respectively arranged on the R to L inward of the tip sides of the right boom 10R and the left boom 10L. Upper end sides of the bucket cylinders C2 are pivotally supported via first bucket cylinder pins 26 by the booms 10R and 10L, thereby being freely rotatable centering around the axis extending along the right to left direction (or along the left to right direction). Lower end sides of the bucket cylinders C2 are pivotally supported via second bucket cylinder pins 27 by the attachment 23, thereby being freely rotatable centering around the axis extending along the right to left direction (or along the left to right direction). When the bucket cylinders C2 are stretched and shortened, the bucket 11 is swung by the stretching and shortening.

In the embodiment, each of the travel units 5 provided to the right side and the left side employs a wheel type travel unit having a front wheel 5F and a rear wheel 5R. Meanwhile, the travel units 5 may employ a travel unit of a crawler type (including a semi-crawler type).

Figure 3:
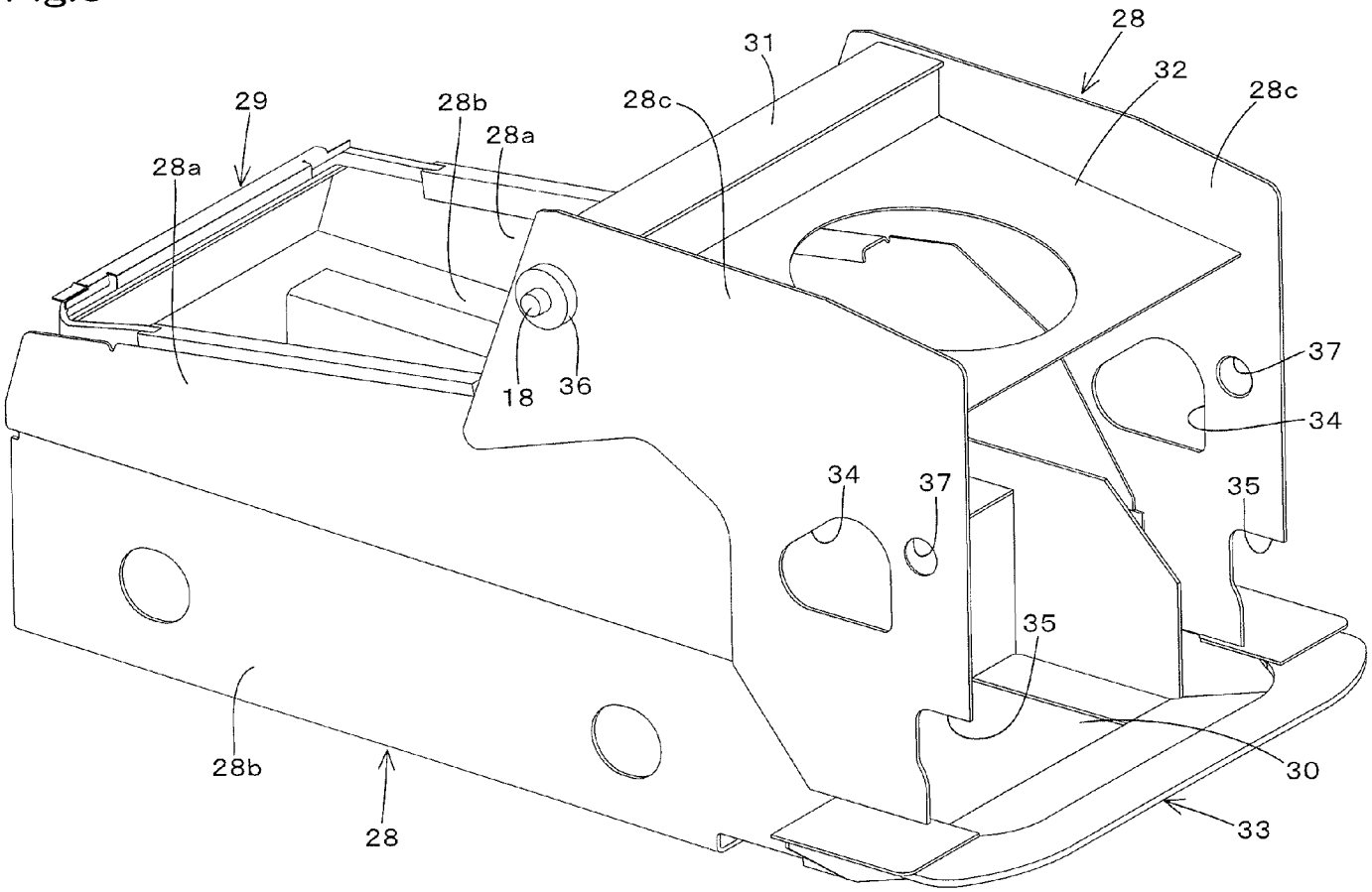
FIG. 3 is a perspective view showing a machine frame diagonally from a left rear of the machine frame.

As shown in FIG. 3, the machine frame 2 is configured mainly by connecting a right side frame 28 and a left side frame 28 with use of a front frame 29, a bottom wall 30, an upper front wall 31, upper rear wall 32, a rear frame 33, and the like.

The front frame 29 connects a front end side of the right side frame 28 to a front end side of the left side frame 28 each other. The bottom wall 30 connects a lower end side of the right side frame 28 to a lower end side of the left side frame 28 each other. The upper front wall 31 and the upper rear wall 32 connect an upper end side of a rear portion of the right side frame 28 to an upper end side of a rear portion of the left side fame 28 each other. The rear frame 33 connects a lower end side of the rear portion of the right side frame 28 to a lower end side of the rear portion of the left side frame 28 each other.

The right side frame 28 and the left side frame 28 each include: an upper main wall 28*a* and a lower main wall 28*b*; and a rear wall 28*c*. The upper main walls 28*a* and the lower main walls 28*b* are provided to the machine frame 2, the upper main walls 28*a* and the lower main walls 28*b* extending from the front portion of the machine frame 2 to the rear portion. The rear wall 28*c* is fixed to rear portions of the upper main walls 28*a* and to rear portions of the lower main walls 28*b*.

The front wheel 5F and the rear wheel 5R of the travel unit 5 are attached to the lower main wall 28*b*.

A through-hole 34, the through-hole 34 being used for inserting a hydraulic hose, is formed in an intermediate portion of the rear portion of the rear wall 28*c* of the side frame 28, the intermediate portion being intermediate in a vertical direction. A notch (a cutout) 35, the notch 35 making a passage for a hydraulic hose, is formed in a lower portion of a rear end of the rear wall 28*c*. In addition, a support boss 36, the support boss 36 being used for supporting the third pivot 18, is provided on a front end side of an upper portion of the rear wall 28*c*. Moreover, an attachment hole 37 is formed on a rear end side of the upper portion of the rear wall 28*c* (on a rear side of an upper portion of the through-hole 34), the attachment hole 37 being used for attachment of a support boss supporting the second pivot 17.

A side surface of the rear portion of the rear wall 28*c*, the side surface facing in a direction of the R to L outward, is covered with a cover plate 38 shown in FIG. 1 and FIG. 2.

A tank for the hydraulic operation fluid, a control valve for the attachment, a control valve for the boom, a control valve for the bucket, a control valve for the locking, and the like are arranged in the machine frame 2 in addition to the engine 6, the HST pumps 7F and 7R, the first pump P1, the second pump P2, and the third pump P3.

The tank for the hydraulic operation fluid sores the hydraulic operation fluid. The control valve for the attachment controls a hydraulic actuator provided to a hydraulic attachment, the hydraulic attachment being attached instead of the bucket 11. The control valve for the boom controls the boom cylinder C1. The control valve for the bucket controls the bucket cylinder C2. The control valve for the locking controls the lock cylinder C3.

Figure 4:
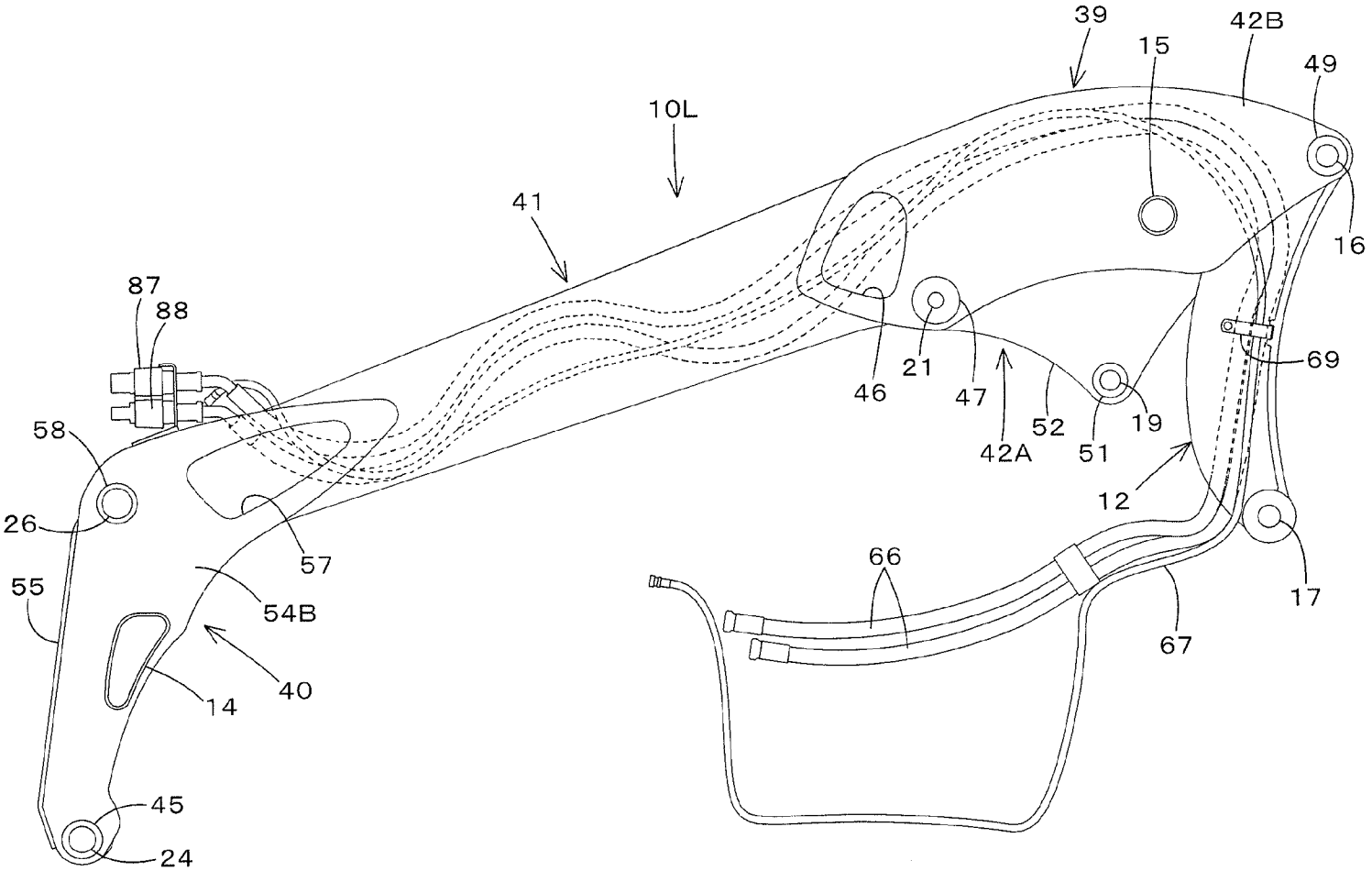
FIG. 4 is a side view of a boom provided to a left side.
Figure 5:
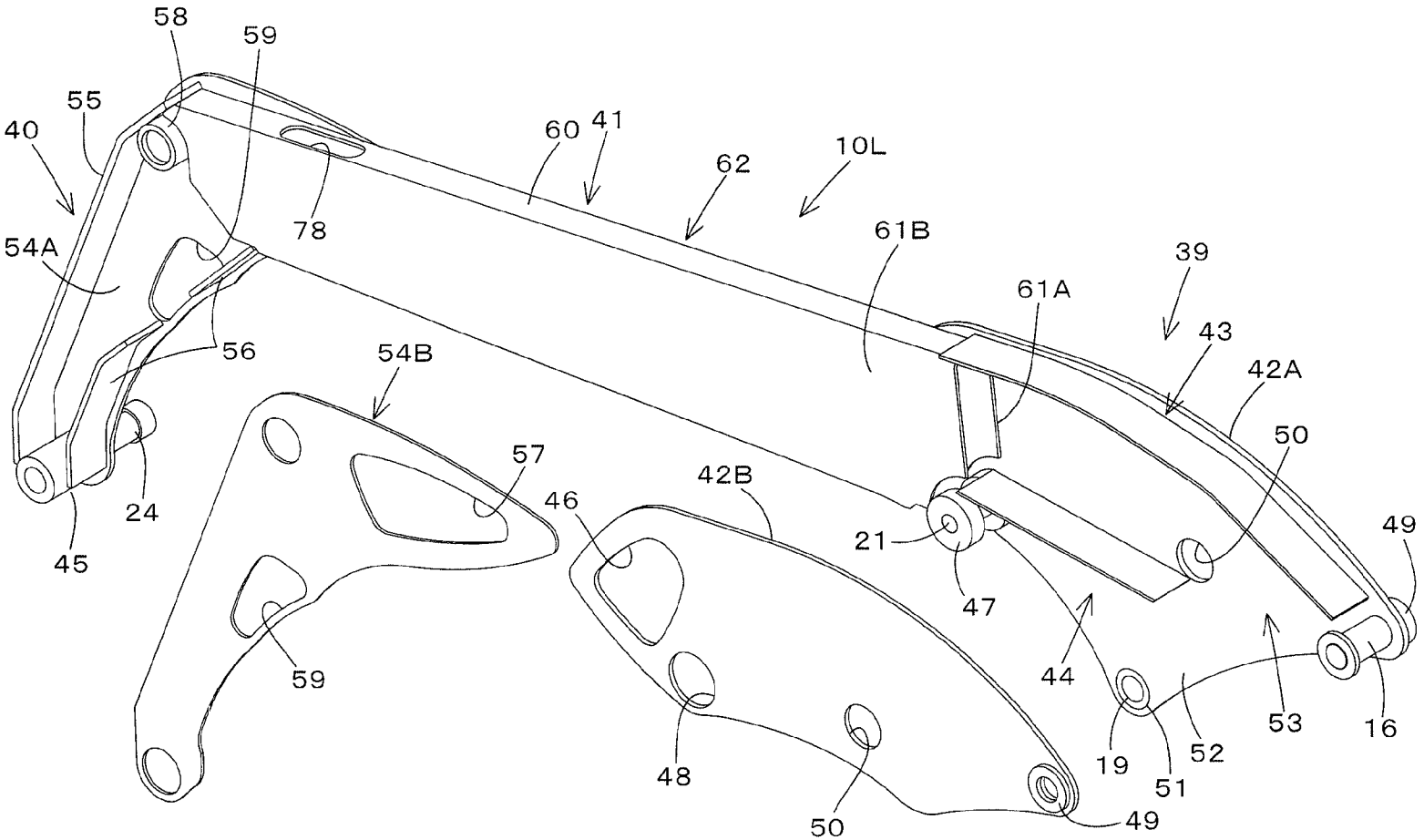
FIG. 5 is an exploded perspective view of the boom provided to the left side.

As shown in FIG. 4 and FIG. 5 each illustrating the left boom 10L, the booms 10R and 10L each include: a boom base portion 39 constituting base portions of the booms 10L and 10R; a boom tip end portion 40 constituting tip end sides of the booms 10L and 10R; and a boom intermediate portion 41 connecting the boom base portion 39 to the boom tip end portion 40 each other.

A front portion of each of the booms 10R and 10L is constituted of: the boom tip end portion 40; and a front portion of the boom intermediate portion 41. And, a rear portion of each of the booms 10R and 10L is constituted of: the boom base portion 39; and a rear portion of the boom intermediate portion 41.

The boom base portion 39 has: an inner side wall 42A facing in the direction of the R to L inward; an outer side wall 42B facing in the direction of the R to L outward; and connection walls 43 and 44 provided upward and downward, the connection walls 43 and 44 connecting the inner side wall 42A to the outer side wall 42B each other.

Figure 8:
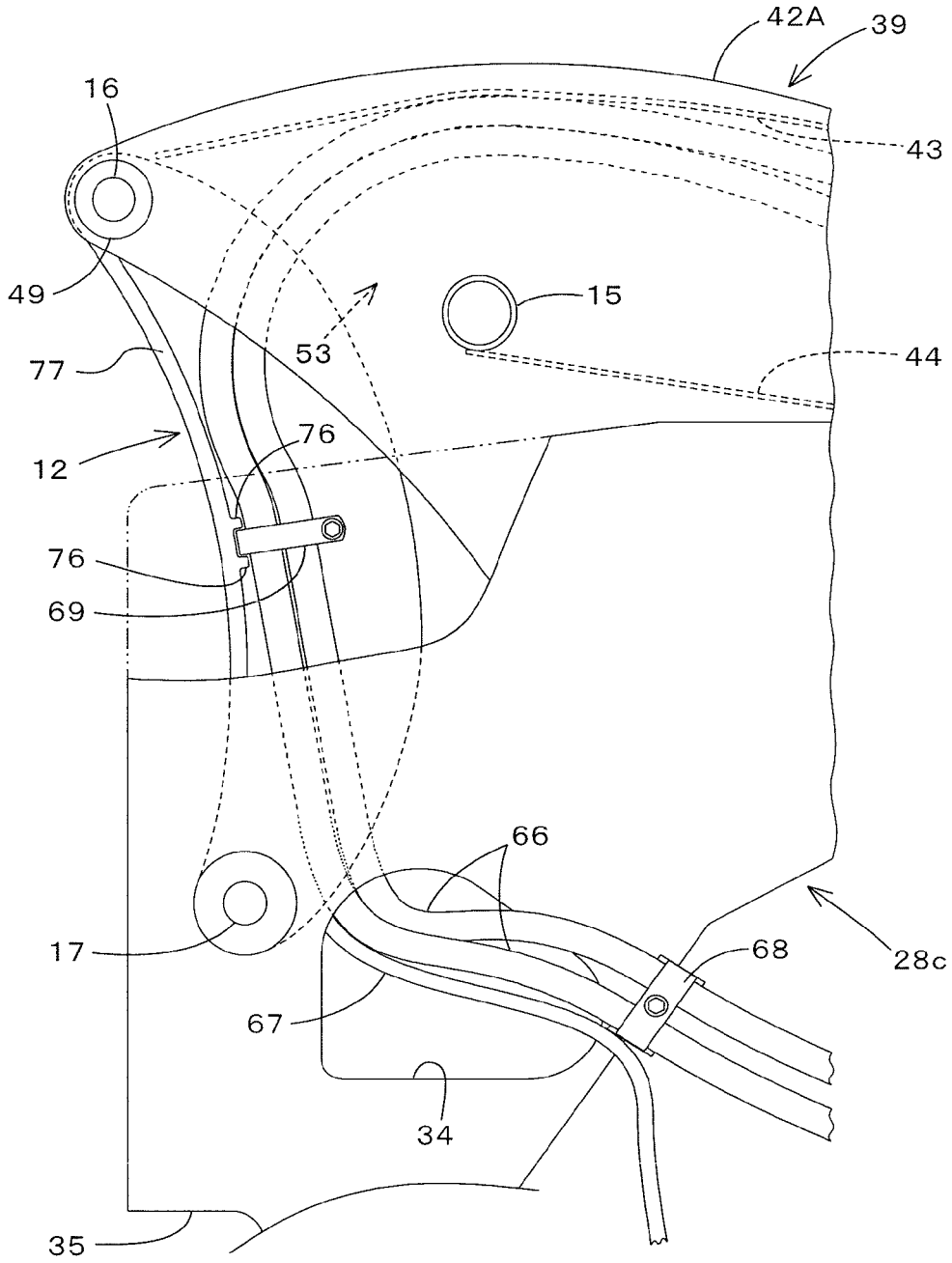
FIG. 8 is a side view showing a supporting portion of the base portion side of the boom provided to the left side from an inward direction along a right to left direction (or along a left to right direction) of the skid steer loader.
Figure 9:
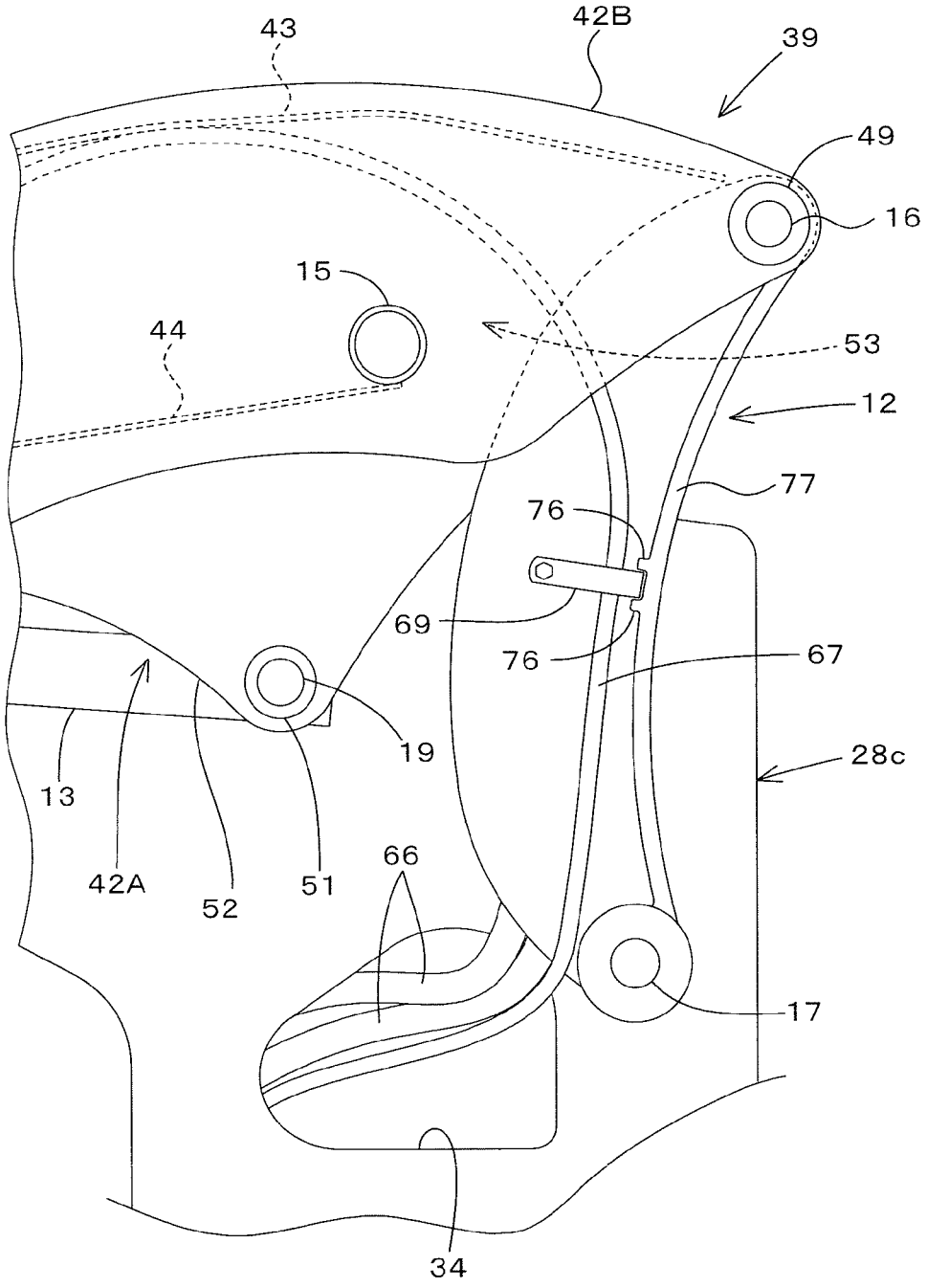
FIG. 9 is a side view showing the supporting portion of the base portion side of the boom provided to the left side from an outward direction along the right to left direction (or along the left to right direction) of the skid steer loader.

As shown in FIG. 8 and FIG. 9, an upper portion of the lift link 12 is inserted to a rear end side of the boom base portion 39, the rear end side being between the inner side wall 42A and the outer side wall 42B. An upper end side of the lift link 12 is pivotally supported by the first pivot 16 between the inner side wall 42A and the outer side wall 42B of the boom base portion 39.

As shown in FIG. 4 and FIG. 5, front portions of the inner side wall 42A and the outer side wall 42B of the boom base portion 39 are each overlapped on a side surface of a rear portion of the boom intermediate portion 41 and welded to be fixed to the side surface, the side surface being provided on the same side as each of the inner side wall 42A and the outer side wall 42B in the right to left direction (the left to right direction). An opening 46 for welding is formed in the front portion of the inner side wall 42A and in the front portion of the outer side wall 42B. A rim of the opening 46 for welding is welded to the side surface of the boom intermediate portion 41.

In addition, an attachment hole 48 is formed on a rear side of (posterior to) the opening 46 for welding formed in a front lower portion of each of the inner side wall 42A and the outer side wall 42B of the boom base portion 39, the attachment hole 48 being used for attachment of a support boss 47 supporting the first boom cylinder pin 21. Moreover, a support boss 49 supporting the first pivot 16 is provided to a rear end portion of each of the inner side wall 42A and the outer side wall 42B of the boom base portion 39. An insertion hole 50 is formed on a front side of (anterior to) the support boss 49, the insertion hole 50 being used for insertion and fixation of the rear connection member 15.

Additionally, an extension wall part 52, the extension wall part 52 being extended and protruding toward a lower side to be lower than a bottom edge of the outer side wall 42B, is provided to a lower portion of an intermediate portion along the front to rear direction, the intermediate portion being a part of the inner side wall 42A. The fourth pivot 19 is supported via a support boss 51 by a lower end side of the extension wall part 52.

Figure 6:
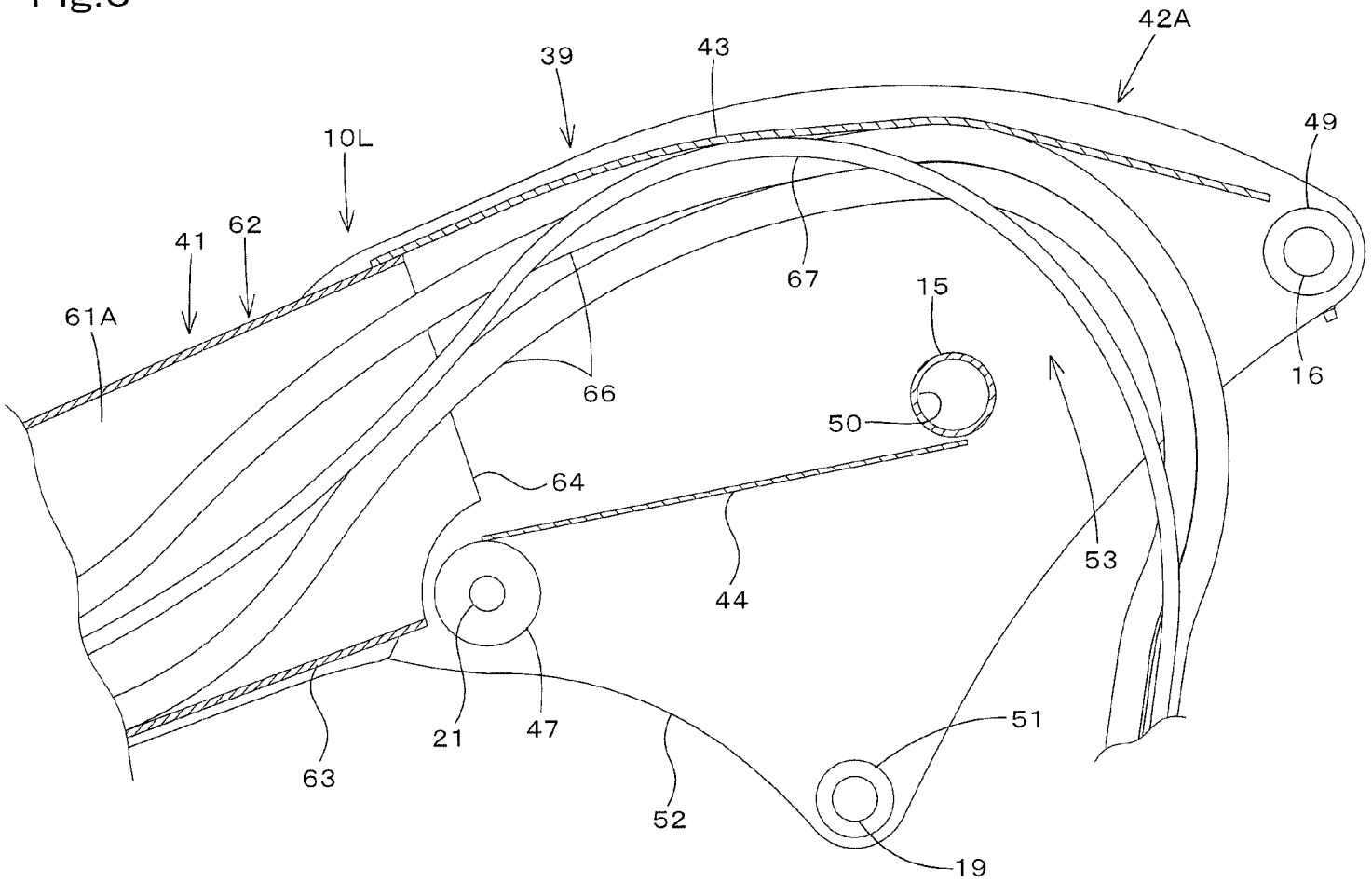
FIG. 6 is a side cross-sectional view of a base portion side of the boom provided to the left side.

As shown in FIG. 6, the connection wall 43 (referred to as the upper connection wall 43) is provided to the upper side of the boom base portion 39 to be formed along upper rim portions of the inner side wall 42A and the outer side wall 42B. A front end of the upper connection wall 43 is welded to be fixed to a rear end portion of an upper surface of the boom intermediate portion 41. A rear end of the upper connection wall 43 is positioned in the vicinity of the first pivot 16. Ends of right and left sides of the upper connection wall 43 are welded to be fixed to the inner side wall 42A and to the outer side wall 42B.

In addition, the connection wall 44 (referred to as the lower connection wall 44) is provided to the lower side of the bottom base portion 39 to be extended from an upper end of the support boss 47 to a lower side of the rear connection member 15. Ends of right and left sides of the upper connection wall 43 are welded to be fixed to the inner side wall 42A and to the outer side wall 42B.

A space between the upper connection wall 43 and the lower connection wall 44 is opened toward the front. In addition, a space between the upper connection wall 43 and the lower connection wall 44 is opened toward the rear. In such structure, a space between a rear end of the upper connection wall 43 and a rear end of the lower connection wall 44 is a hose insertion hole 53, the hose insertion hole 53 being a hole used for insertion of the hydraulic hose into the booms 10R and 10L.

As shown in FIG. 4 and FIG. 5, a boom tip end portion 40 includes an inner side wall 54A provided to the R to L inward, an outer side wall 54B provided to the R to L outward, a connection wall 55 (referred to as a front connection wall 55) provided to the front, and a connection wall 56 (referred to as a rear connection wall 56) provided to the rear, the front connection wall 55 and the rear connection wall 56 connecting the inner side wall 54A to the outer side wall 54B each other.

Upper portions of the inner side wall 54A and the outer side wall 54B, the inner side wall 54A and the outer side wall 54B being included in the boom tip end portion 40, are each overlapped on a side surface of a front portion of the boom intermediate portion 41 and welded to be fixed to the side surface, the side surface being provided on the same side as each of the inner side wall 54A and the outer side wall 54B in the right to left direction (the left to right direction). In addition, the upper portions of the inner side wall 54A and the outer side wall 54B, the inner side wall 54A and the outer side wall 54B being included in the boom tip end portion 40, are each formed along the longitudinal direction of the boom intermediate portion 41, and the lower portions of the inner side wall 54A and the outer side wall 54B are each bent to be extended downward from the boom intermediate portion 41.

An opening 57 for welding is formed in a rear portion of the upper portion of the inner side wall 54A and the outer side wall 54B, the inner side wall 54A and the outer side wall 54B being included in the boom tip end portion 40. A rim of the opening 57 for welding is welded to the side surface of the boom intermediate portion 41. A support boss 58, the support boss 58 being used for supporting the first bucket cylinder pin 26, is provided in the front portions in the upper portions of the inner side wall 54A and the outer side wall 54B, the inner side wall 54A and the outer side wall 54B being included in the boom tip end portion 40.

A support boss 45, the support boss 45 supporting the pivotally-supporting pin 24, is provided to a lower end of each of the inner side wall 54A and the outer side wall 54B, the inner side wall 54A and the outer side wall 54B being included in the boom tip end portion 40. An insertion hole 59 used for insertion of the front connection member 14 is formed in a lower portion of an intermediate portion of each of the inner side wall 54A and the outer side wall 54B, the inner side wall 54A and the outer side wall 54B being provided respectively to right and left sides of the boom tip end portion 40.

Figure 7:
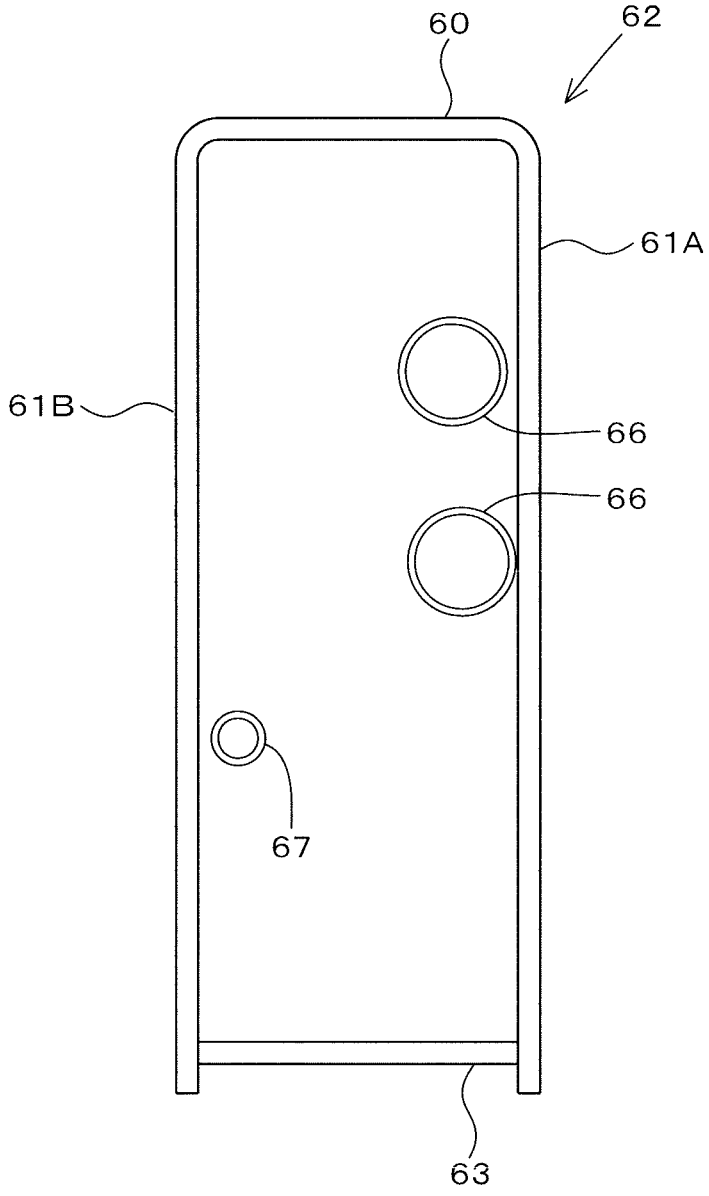
FIG. 7 is a cross-sectional view of an intermediate portion of the boom.

As shown in FIG. 7, the boom intermediate portion 41 includes an upper wall 60, a main member 62, and a bottom wall 63. The mail member 62 is formed to have a C-shape in a cross section, the C-shape being constituted of: an inner side wall 61A provided on a side in the R to L inward Y2; and an outer side wall 61B provided on a side in the R to L outward Y1. The bottom wall 63 connects between lower end portions of the inner side wall 61A and the outer side wall 61B, the inner side wall 61A and the outer side wall 61B constituting the main member 62. A front end and a rear end of the boom intermediate portion 41 each have an opening ape.

As shown in FIG. 6, a rear end side of the boom intermediate portion 41 is inserted into a front end side of the boom base portion 39. In addition, an opening 64 provided to the rear end (hereinafter referred to as a rear end opening 64) of the boom intermediate portion 41 is communicated with a space between the upper connection wall 43 and the lower connection wall 44, the upper connection wall 43 and the lower connection wall 44 being included in the boom base portion 39.

As shown in FIG. 4, two hydraulic hoses (two first hydraulic hoses) 66 for the hydraulic operation fluid and one hydraulic hose (one second hydraulic hose) 67 for drain are internally installed in the boom 10L provided to the left, the first hydraulic hose 66 being used for passage of the hydraulic operation fluid, the second hydraulic hose 67 being used for passage of the drain fluid (a drain oil).

The hydraulic hose 66 for the hydraulic operation fluid guides the hydraulic operation fluid to a hydraulic attachment attached to the attachment 23, the attachment 23 being provided to the tip end portion of the boom 10L. To be more detailed, the hydraulic hose 66 for the hydraulic operation fluid is a hydraulic hose to guide the hydraulic operation fluid, the hydraulic operation fluid being used for driving a hydraulic actuator provided to the hydraulic attachment, (the hydraulic hose being referred to as an attachment hose).

The hydraulic hose 67 for the drain is a hydraulic hose to return a pressure fluid (a pressure oil), the pressure fluid leaking from the hydraulic actuator provided to the hydraulic attachment, to the tank for the hydraulic operation fluid, the tank being provided to the machine frame 2, (the hydraulic hose being referred to as a drain hose). The attachment hose 66 is formed to have larger diameter than a diameter of the drain hose 67.

As shown in FIG. 8 and FIG. 9, the attachment hose 66 and the drain hose 67 are arranged from the inside of the machine frame 2 toward the outside of the machine frame 2 outward through the through-hole 34 formed in the side frame 28 provided to the left side.

Figure 10:
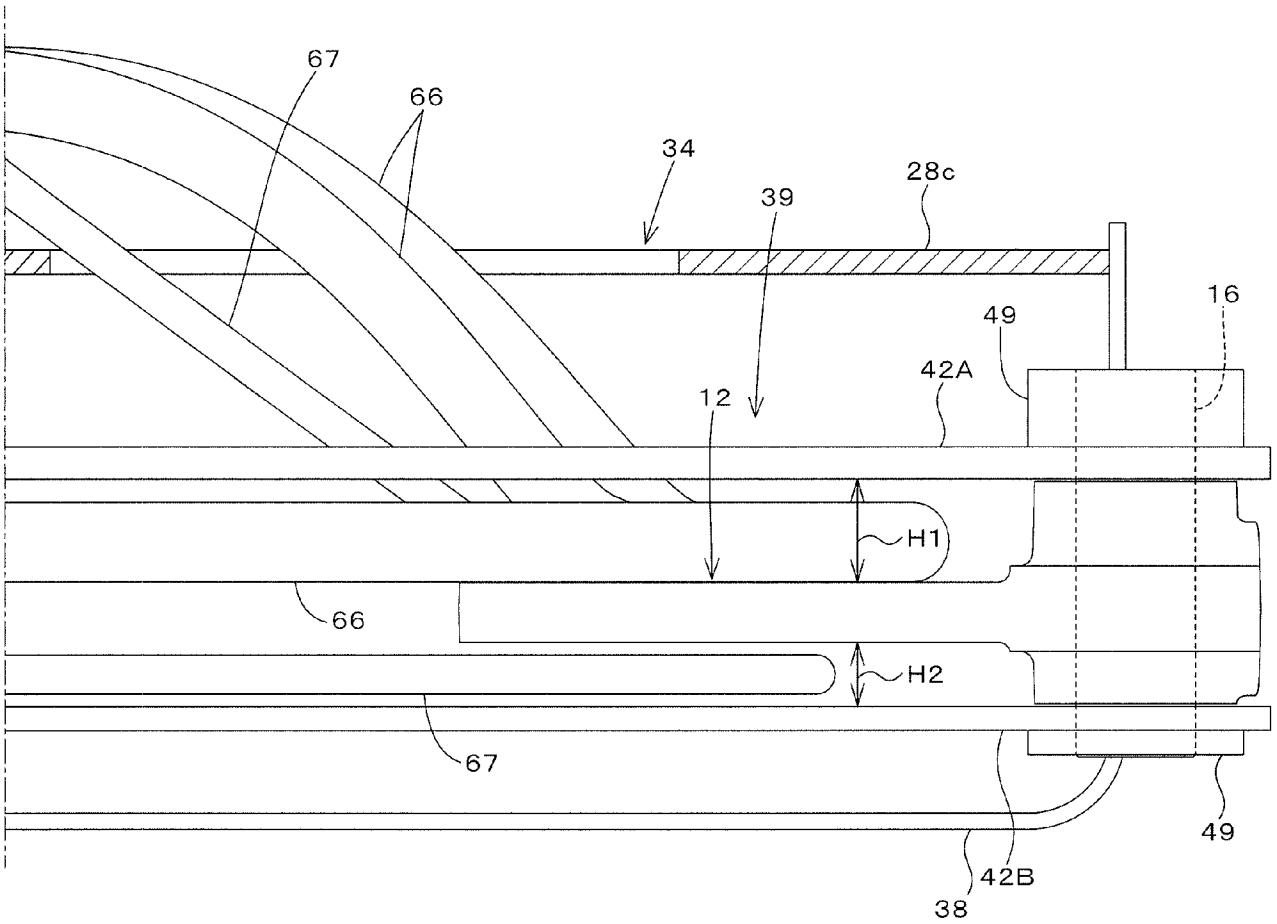
FIG. 10 is a plan view of the base portion side of the boom provided to the left.

As shown in FIG. 8 and FIG. 10, the attachment hose 66 is arranged from the inside of the machine frame 2 to the outside through the through-hole 34; after that, the attachment hose 66 is arranged from a lower portion of the lift link 12 to an upper portion of the lift link 12 along a side surface of the lift link 12, the side surface facing in the direction of the R to L inward. Subsequently, in an upper portion of the lift link 12, the attachment hose 66 passes through a space between the lift link 12 and the inner side wall 42A of the boom base portion 39 and through the front of the first pivot 16 (a space between the first pivot 16 and the rear connection member 15), and then the attachment hose 66 is inserted from the hose insertion hole 53 into the inside of the boom base portion 39.

In addition, as shown in FIG. 8, the attachment hose 66 is fixed to the side frame 28 by a clamp member 68 in the vicinity of the through-hole 34 provided inside the machine frame 2.

As shown in FIG. 9 and FIG. 10, the drain hose 67 is arranged from the inside of the machine frame 2 to the outside of the machine frame 2 through the through-hole 34, and then the drain hose 67 is arranged from the lower portion of the lift link 12 to the upper portion of the lift link 12 along a side surface of the lift link 12, the side surface facing in the direction of the R to L outward. Subsequently, in an upper portion of the lift link 12, the drain hose 67 passes through a space between the lift link 12 and the outer side wall 42B of the boom base portion 39 and through the front of the first pivot 16 (the space between the first pivot 16 and the rear connection member 15), and then the drain hose 67 is inserted via the hose insertion hole 53 from a lower side into the inside of the boom base portion 39.

As shown in FIG. 6, after inserted into the inside of the boo base portion 39, the attachment hose 66 and the drain hose 67 are inserted from the rear end opening 64 of the boom intermediate portion 41 into the inside of the boom intermediate portion 41. Moreover, as shown in FIG. 4, the attachment hose 66 and the drain hose 67 are arranged through the inside of the boom intermediate portion 41 toward the front end side of the boom intermediate portion 41.

Additionally, as shown in FIG. 10, an interval H1 of a space between the lift link 12 and the inner side wall 42A of the boom base portion 39 is formed to be larger than an interval H2 of a space between the lift link 12 and the outer side wall 42B of the boom base portion 39. In this manner, the attachment hose 66 having a large diameter can pass through the space between the lift link 12 and the inner side wall 42A of the boom base portion 39.

As described above, the attachment hose 66 having a large diameter is arranged along one of the side surfaces of the lift link 12, the one being closer to the machine frame 2 than the other one, thereby making the arrangement of the attachment hose 66 easy and preventing the attachment hose 66 from contacting to a rim of the opening of the through-hole 34.

Meanwhile, in the embodiment, the interval H1 is the space between the lift link 12 and the inner side wall 42A of the boom base portion 39 is enlarged to secure an arrangement path of the hydraulic hose having a large diameter; however, not limited to that, the interval H2 of the space between the lift link 12 and the outer side wall 42B of the boom base portion 39 may be formed to be larger than the interval H1 of the space between the lift link 12 and the inner side wall 42A of the boom base portion 39. In this case, the hydraulic hose having a larger diameter is arranged between the lift link 12 and the outer side wall 42B of the boom base portion 39, and the hydraulic hose having a smaller diameter is arranged between the lift link 12 and the inner side wall 42A of the boom base portion 39.

In addition, as shown in FIG. 8 and FIG. 9, a hose guide 69 is provided to an intermediate portion in the vertical direction, the intermediate portion being included in each of the side surfaces of the lift link 12, one of the side surfaces facing in the direction of the R to L inward and the other one of the side surfaces facing in the direction of the R to L outward. The hose guide 69 allows movement of the attachment hose 66 and the drain hose 67 in the longitudinal direction, although regulates the movement of the hoses 66 and 67 in the right to left direction (or the left to right direction).

Figure 11A:
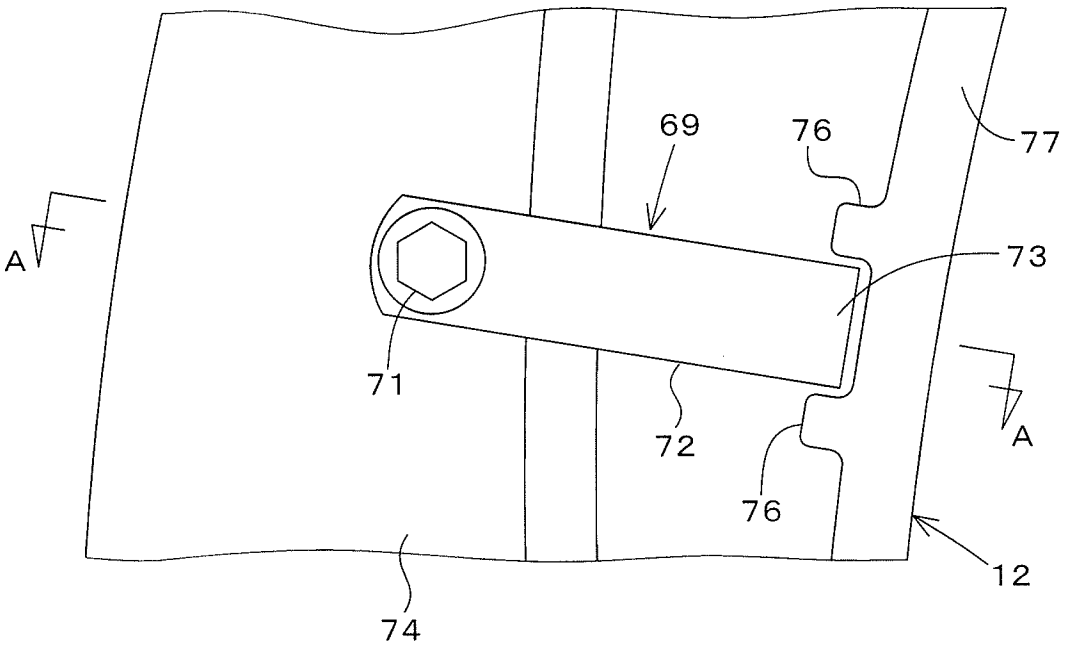
FIG. 11A is a side view of a hose guide.
Figure 11B:
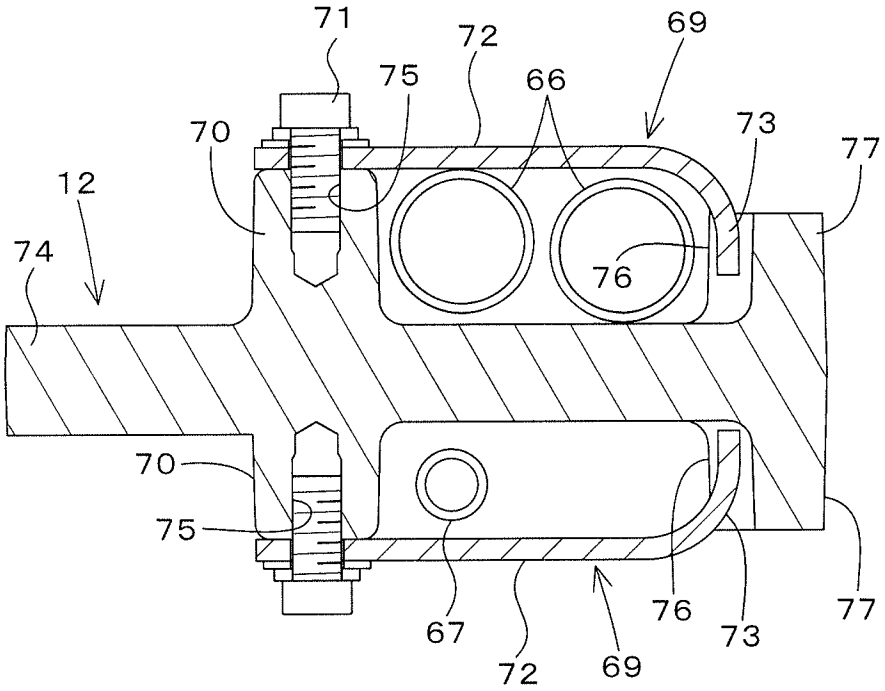
FIG. 11B is a view showing a cross-section taken an A-A arrowed line.

Moreover, as shown in FIG. 11, the hose guide 69 is fixed, by a bolt 71, to an installation part 70 provided to the intermediate portion of the side surface of the lift link 12, the intermediate portion being a portion intermediate in both of the vertical direction and the front to rear direction.

Further, the hose guide 69 is formed of a plate that has a surface facing the right to left direction (or the left to right direction) and is long in the front to rear direction. Furthermore, the hose guide 69 includes: a main plate portion 72 regulating the movement of the hydraulic hoses 66 and 67 in the right to left direction (or the left to right direction); and a bend portion 73 provided by being extended from a rear end of the main plate part 72 toward a lift link 12. The bend portion 73 is formed by bending a plate to be in a curved shape, the plate constituting the hose guide 69.

The installation part 70 is formed to protrude from a main body wall portion 74 of the lift link 12 toward the R to L inward and toward the R to L outward. A screw hole 75 is formed in the installation part 70, the screw hole 75 having an axis extending along the right to left direction (or along the left to right direction).

A front portion of the hose guide 69 is overlapped with an end portion of the protrusion of the installation part 70. Additionally, the bolt 71 penetrating the hose guide 69 is screwed with the screw hole 75. In this manner, the hose guide 69 is attached and fixed to the installation part 70, and a space is formed between the main plate portion 72 of the hose guide 69 and the main body wall portion 74 of the lift link 12 to allow insertion of the hoses 66 and 67 into the space.

Meanwhile, in the embodiment, heights of the protrusions of the right and left installation parts 70 from the main body wall portion 74 are different from each other depending on diameters of the hose 66 and 67 inserted. In the embodiment, the installation parts 70 are formed so that the height of the installation part 70 provided on the side of the R to L inward is larger than the height of the installation part 70 provided on the side of the R to L outward.

In addition, a regulation portion 76 is provided to the lift link 12, the regulation portion 76 being positioned above and below the bend portion 73 of the hose guide 69. Accordingly, the regulation portions 76, the regulation portions 76 being provided above and below the bend portion 73, regulates the upward and downward movement of the hose guide 69 around an axis of the bolt 71.

The regulation portions 76 is extended from a rib wall 77 provided along a rear edge side of the main body wall portion 74 of the lift link 12 toward the front side.

In the embodiment, the main plate portion 72 of the hose guide 69 regulates, in the right to left direction (or the left to right direction), the movement of the portions of the attachment hose 66 and the drain hose 67, the portions being arranged along the side surfaces of the lift link 12. The installation part 70 regulates the movement of the front portions of the attachment hose 66 and the drain hose 67. In addition, the bend portion 73 and the rib wall 77 regulate the movement of the rear portions of the attachment hose 66 and the drain hose 67, the bend portion 73 being included in the hose guide 69, the rib wall 77 being included in the lift link 12.

As described above, the attachment hose 66 and the drain hose 67 are arranged on the intermediate portion of the lift link 12 in the vertical direction by the hose guide 69 so that the movement of the hoses 66 and 67 is allowed in the longitudinal direction but regulated in the right to left direction (or the left to right direction). Accordingly, the hydraulic hoses 66 and 67 smoothly bend and follow the upward and downward swinging of the booms 10R and 10L, the swinging being performed centering around the first pivot 16, thereby preventing the hydraulic hoses 66 and 67 from being forcibly moved.

Figure 12A:
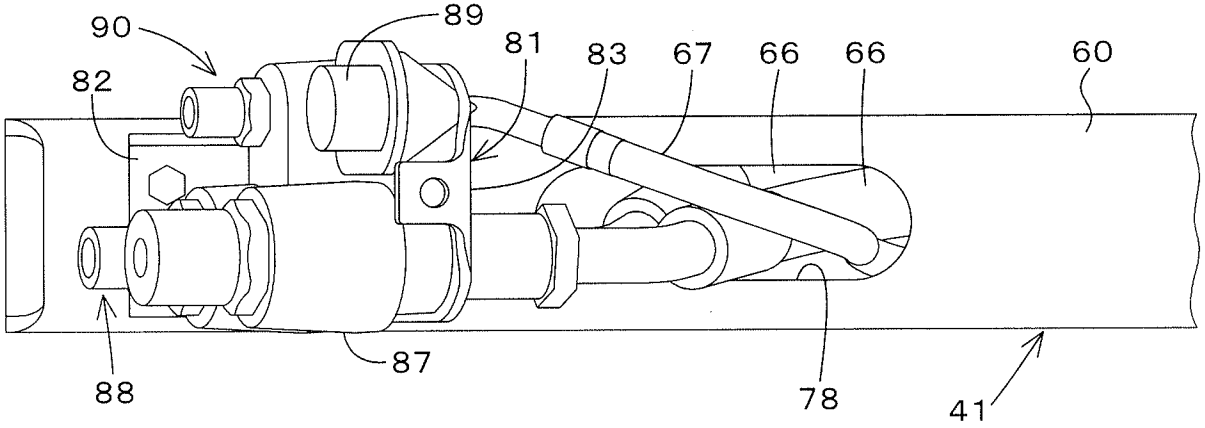
FIG. 12A is a plan view of a hydraulic pressure extraction part.
Figure 12B:
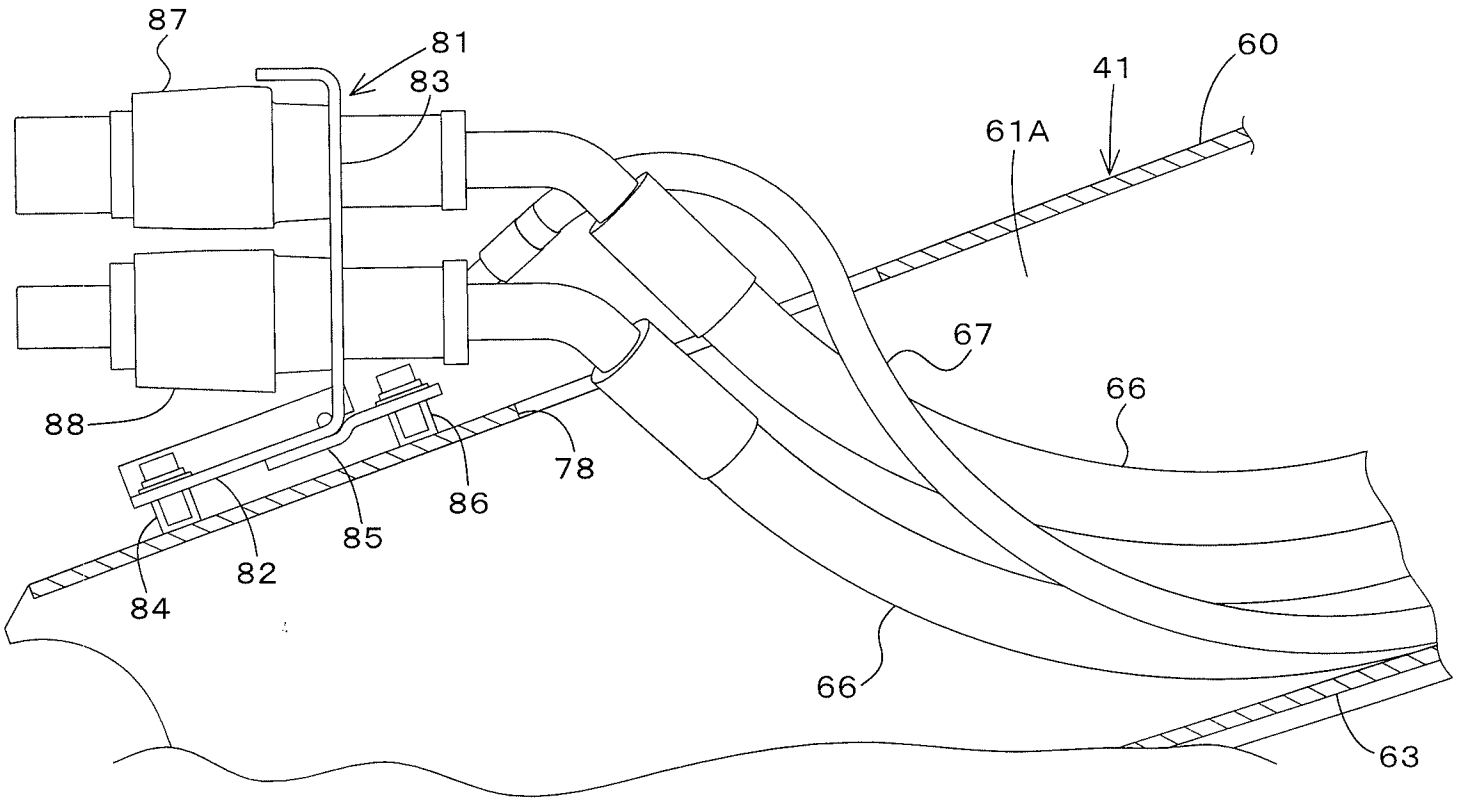
FIG. 12B is a cross-section view showing a part of a side of the hydraulic pressure extraction part.

As shown in FIG. 5 and FIG. 12, a hose outlet opening 78 is formed to be opened in a font portion of the upper wall 60 of the boom intermediate portion 41 provided to the left. The hose outlet opening 78 is formed to be in a rectangular shape elongated in the front to rear direction.

Front end sides of the attachment hose 66 and the drain hose 67 both internally installed in the left boom 10L are brought out from the inside of the boom 10L through the hose outlet opening 78.

In addition, a coupler attachment stay 81 is provided to the upper wall 60 of the boom intermediate portion 41 provided to the left. The coupler attachment stay 81 is provided to the front side of the hose outlet opening 78.

The coupler attachment stay 81 includes a lower wall 82 and an attachment wall 83 extended upward from a rear end of the lower wall 82. A front portion of the lower wall 82 of the coupler attachment stay 81 is attached to and fixed to a fixation member 84 by a bolt, the fixation member 84 being fixed to an upper surface of the upper wall 60 of the boom intermediate portion 41. Additionally, an attachment bracket 85 is provided to a rear portion of the lower wall 82 of the coupler attachment stay 81. The attachment bracket 85 is attached to and fixed to a fixation member 86 by a bolt, the fixation member 86 being fixed to the upper surface of the upper wall 60 of the boom intermediate portion 41.

A first hydraulic coupler 87 and a second hydraulic coupler 88 are attached on a side of the R to L outward of the attachment wall 83 of the coupler attachment stay 81. The first hydraulic coupler 87 is attached to an upper portion of the attachment wall 83. The second hydraulic coupler 88 is attached to a lower portion of the attachment wall 83.

One of the attachment hoses 66 is connected to the first hydraulic coupler 87. The other one of the attachment hoses 66 is connected to the second hydraulic coupler 88. In addition, the first hydraulic coupler 87 and the second hydraulic coupler 88 are connected to the hydraulic actuator, the hydraulic actuator being provided to the hydraulic attachment, by a hydraulic hose. In this configuration, the hydraulic actuator can be driven.

Meanwhile, in the embodiment, the first hydraulic coupler 87 is composed of a female coupler, and the second hydraulic coupler 88 is composed of a male coupler.

A connector 89 and a third hydraulic coupler 90 are attached on a side of the R to L inward of the attachment wall 83 of the coupler attachment stay 81. The connector 89 is attached to the upper portion of the attachment wall 83. The third hydraulic coupler 90 is attached to the lower portion of the attachment wall 83. An electric wiring is connected to the connector 89, the electric wiring being arranged from a power source such as a battery provided on a side of the machine frame 2 through the inside of the left boom 10L. The drain hose 67 is connected to the third hydraulic coupler 90.

The connector 89 is connected to the hydraulic attachment having an electric equipment by the electric wiring. In this manner, electric power can be supplied to the electric equipment of the hydraulic attachment. The third hydraulic coupler 90 is connected via a hydraulic hose to the hydraulic actuator provided to the hydraulic attachment. Thus, the pressure fluid leaking from the hydraulic actuator can be returned to the tank for the hydraulic operation fluid.

The first hydraulic coupler 87 and the second hydraulic coupler 88 are provided so as not to hang out from the boom 10L to the R to L outward. That is intended to prevent, in an operation of the working machine, the first hydraulic coupler 87 and the second hydraulic coupler 88 from hitting to something to be damaged.

In addition, the first hydraulic coupler 87 and the second hydraulic coupler 88 are arranged in a position close to a center of the boom 10L in the right to left direction (or the left to right direction). Accordingly, the attachment hose 66 can be smoothly connected to the couplers, and the connector 89 and the third hydraulic coupler 90 do not widely hang out in a direction of the R to L inward.

Meanwhile, when the connector 89 and the third hydraulic coupler 90 are provided so as not to hang out from the booms 10R and 10L to the R to L outward in a case where the first hydraulic coupler 87 and the second hydraulic coupler 88 are attached on a side of the R to L inward of the attachment wall 83 of the coupler attachment stay 81 and additionally the connector 89 and the third hydraulic coupler 90 are attached on a side of the R to L outward of the attachment wall 83 of the coupler attachment stay 81, a degree of separation of the first hydraulic coupler 87 and the second hydraulic coupler 88 from the center of the boom 10L in the right to left direction becomes large in the right to left direction. Obviously, the large degree of separation is a disadvantage in connecting the first hydraulic coupler 87 and the second hydraulic coupler 88 to the attachment hose 66.

Figure 13:
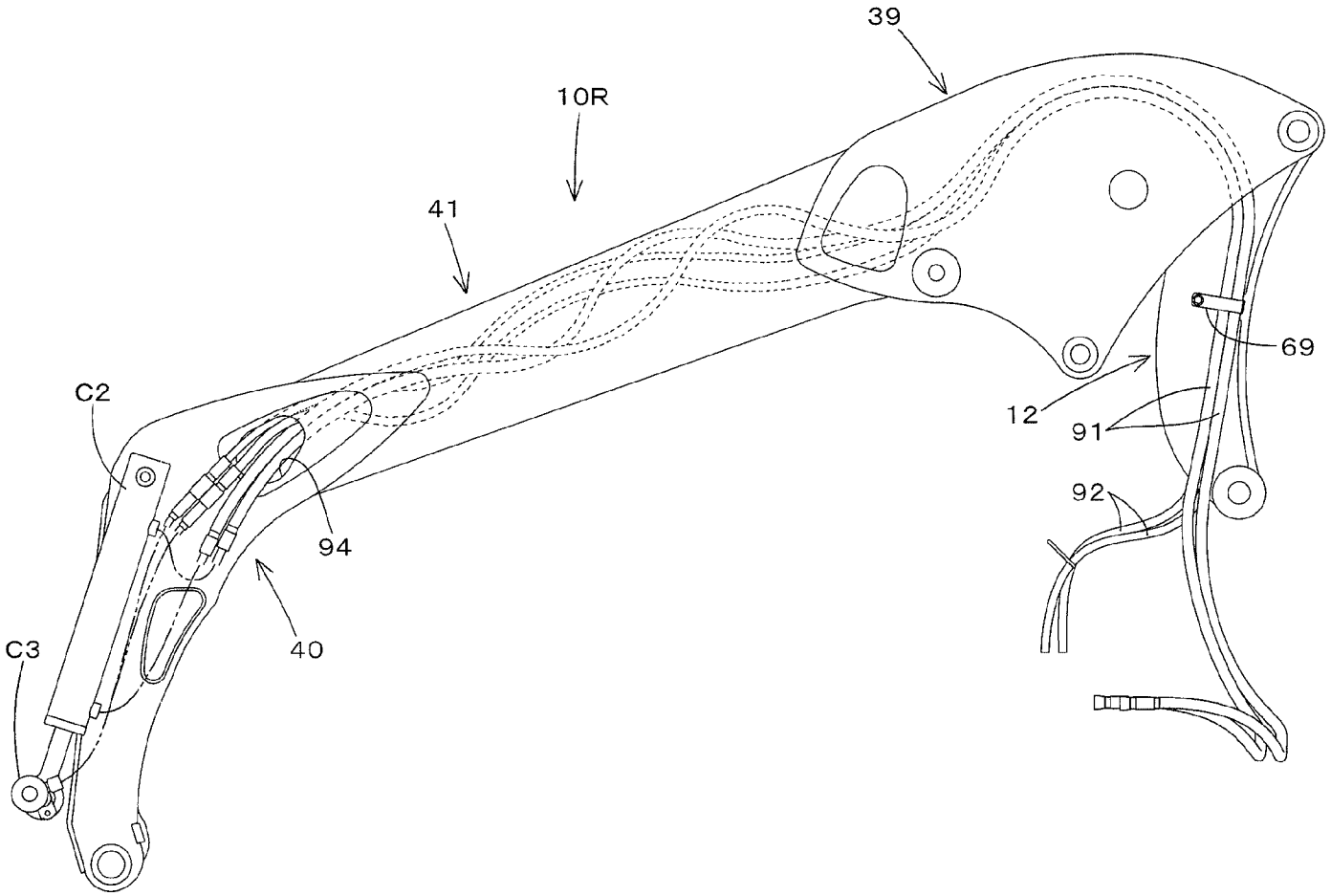
FIG. 13 is a side view of a boom provided to a right side.

FIG. 13 shows the right boom 10R. The left boom 10L has the above-mentioned hose outlet opening 78 in the front portion of the upper wall 60 of the boom intermediate portion 41. On the other hand, the right boom 10R has a hose outlet opening 94 in the front portion of the inner side wall 61A provided on a side of the R to L inward of the boom intermediate portion 41. Configurations of the right boom 10R other than the above-pointed configuration are the same as those of the left boom 10L.

Two hydraulic hoses (two first hydraulic hoses) 91 and two hydraulic hoses (two second hydraulic hoses) 92 are internally installed in the right boom 10R, the first hydraulic hose 91 guiding the hydraulic operation fluid used for driving the bucket cylinder C2, the second hydraulic hose 92 guiding the hydraulic operation fluid used for driving the lock cylinder C3.

The hydraulic hose 91 guiding the hydraulic operation fluid used for driving the bucket cylinder C2 is referred to as a bucket hose. The second hydraulic hose 92 guiding the hydraulic operation fluid used for driving the lock cylinder C3 is referred to as a lock hose.

The bucket hose 91 is formed to have a diameter larger than a diameter of the lock hose 92.

Figure 14:
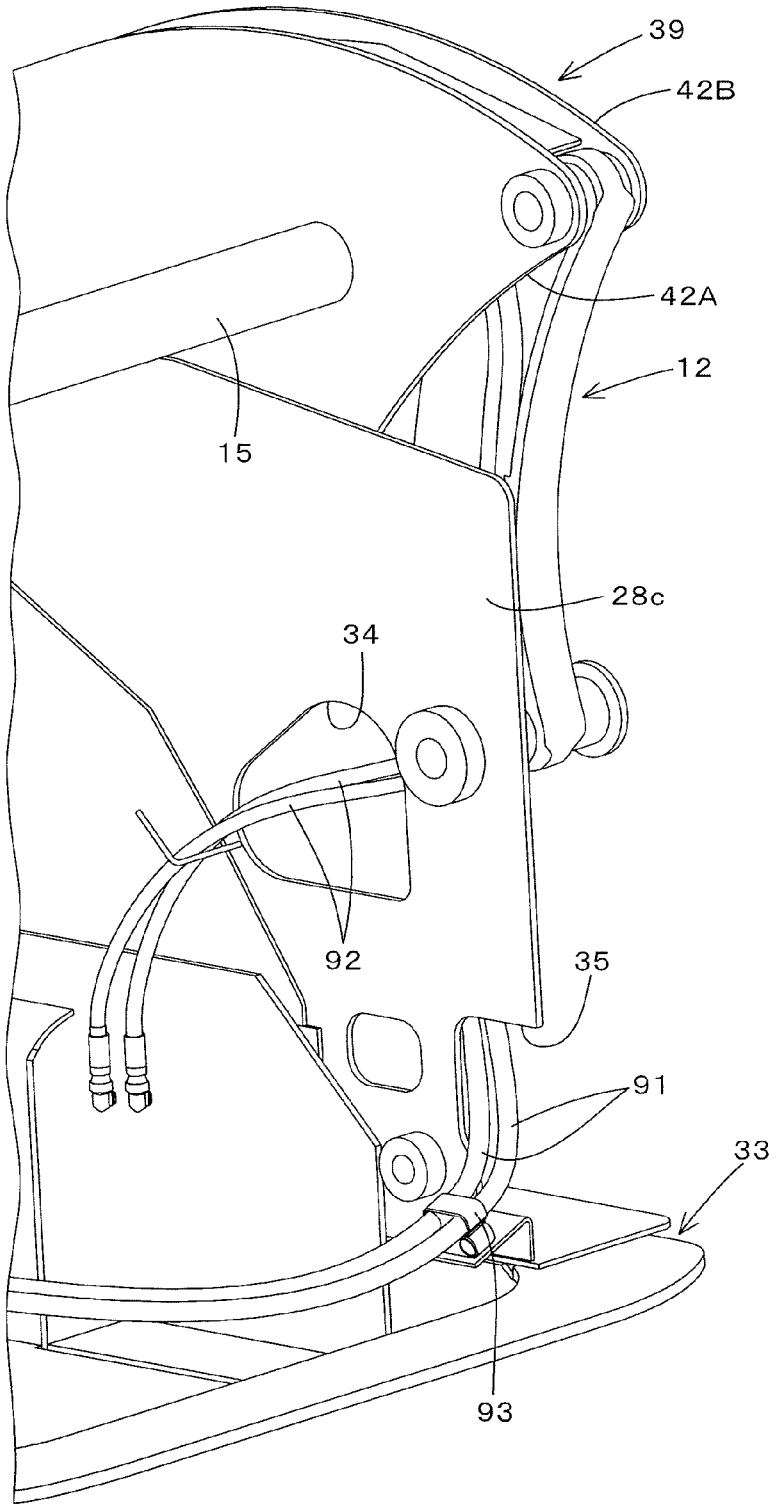
FIG. 14 is a perspective view showing a supporting portion of a base portion side of the boom provided to the right side from the inward direction along the right to left direction (or along the left to right direction) of the skid steer loader.
Figure 15:
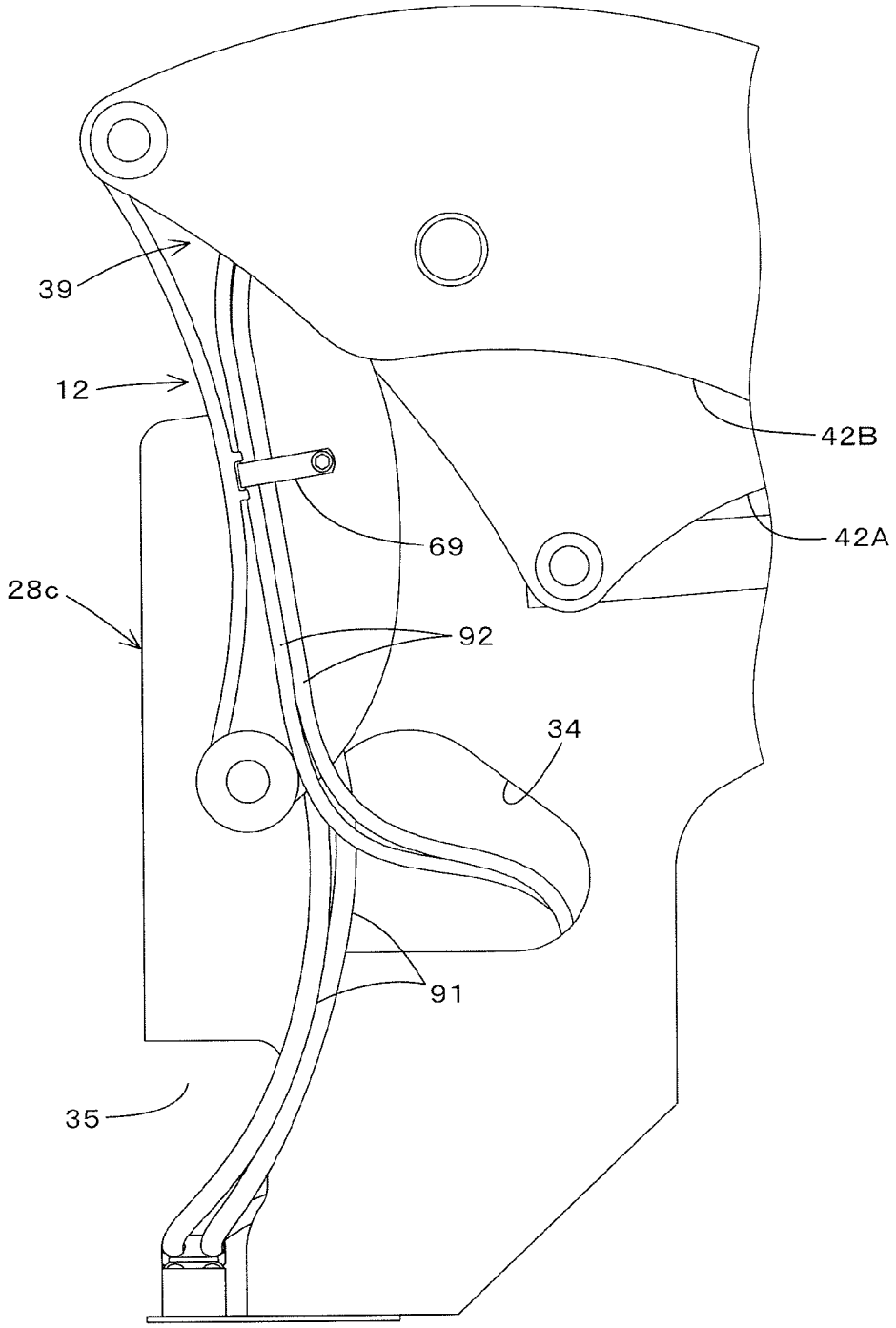
FIG. 15 is a side view showing the supporting portion of the base portion side of the boom provided to the right side from the inward direction along the right to left direction (or along the left to right direction) of the skid steer loader.

As shown in FIG. 14 and FIG. 15, the bucket hose 91 is arranged from the inside of the machine frame 2 to the outside of the machine frame 2 through the notch 35 formed in the right side frame 28. The lock hose 92 is arranged from the inside of the machine frame 2 to the outside of the machine frame 2 through the through-hole 34 formed in the right side frame 28.

The bucket hose 91 is arranged from the inside of the machine frame 2 to the outside through the notch 35, and subsequently is arranged upward. After that, the bucket hose 91 is arranged from the lower portion of the lift link 12 to the upper portion along the side surface of the lift link 12, the side surface facing in the direction of the R to L inward. Subsequently, in the upper portion of the lift link 12, the bucket hose 91 passes through the space between the lift link 12 and the inner side wall 42A of the boom base portion 39 and through the front of the first pivot 16, and then the bucket hose 91 is inserted from the hose insertion hole 53 into the inside of the boom base portion 39.

In addition, the bucket hose 91 is fixed by a clamp member 93 in the vicinity of the notch 35 provided inside the machine frame 2.

The lock hose 92 is arranged from the inside of the machine frame 2 to the outside through the through-hole 34, and subsequently is arranged from the lower portion of the lift link 12 to the upper portion along the side surface of the lift link 12, the side surface facing in the direction of the R to L outward. After that, in the upper portion of the lift link 12, the lock hose 92 passes through the space between the lift link 12 and the outer side wall 42B of the boom base portion 39 and through the front of the first pivot 16 (the space between the first pivot 16 and the rear connection member 15), and then the lock hose 92 is inserted via the hose insertion hole 53 from the lower side into the inside of the boom base portion 39.

The bucket hose 91 and the lock hose 92 are inserted into the inside of the boom intermediate portion 41 after being inserted into the inside of the boom base portion 39. After that, the bucket hose 91 and the lock hose 92 are arranged toward the front end side of the boom intermediate portion 41. As shown in FIG. 13, the front portion sides of the bucket hose 91 and the lock hose 92 are brought out from the hose outlet opening 94 formed in the front portion of the inner side wall 61A of the boom intermediate portion 41.

The front portion side of the bucket hose 91 brought out from the hose outlet opening 94 is connected to the bucket cylinders C2 via a hydraulic pipeline such as the hydraulic pipe and the hydraulic hose, the bucket cylinders C2 being provided to the right and the left.

The front portion side of the lock hose 92 brought out from the hose outlet opening 94 is connected to the lock cylinder C3 via a hydraulic hose and the like.

In the above-configured embodiment, the hydraulic hoses (the attachment hose 66, the drain hose 67, the bucket hose 91, and the lock hose 92) arranged from the rear end sides of the booms 10R and 10L to the front portions are internally installed in the booms 10R and 10L, thereby easily securing a width of the room space of the cabin 3 in the right to left direction.

In addition, the hydraulic hoses 66, 67, 91, and 92 are internally installed by being inserted from the lower side into the booms 10R and 10L through the hose insertion hole 53. Accordingly, the hydraulic hoses 66, 67, 91, and 92 are smoothly inserted into the booms 10R and 10L, the booms 10R and 10L swinging upward and downward centering around the axis extending along the right to left direction (or along the left to right direction) with the rear end side supported as a fulcrum, thereby making the arrangement of the hydraulic hoses easy.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A working machine comprising:
a machine frame;
an operator seat disposed on the machine frame;
a boom disposed on each side of the operator seat, the boom including
a boom base portion disposed on a position corresponding to a rear portion of the machine frame,
a boom tip end portion arranged opposite the boom base portion, and
a boom intermediate portion disposed between the boom base portion and the boom tip end portion;
a boom cylinder having one end connected to the boom base portion an another end connected to the machine frame, the boom cylinder being configured to swing the boom upward and downward; and
a hydraulic hose inserted into a rear side of the boom base portion and being disposed inside the boom intermediate portion, the hydraulic hose being used for passage of an operation fluid.

2. The working machine according to claim 1, further comprising:
a lift link disposed on the boom base portion, the lift link being pivotally supported by a first pivot on the boom base portion at one end portion of the lift link, the lift link being pivotally supported by a second pivot on the machine frame at the other end portion of the lift link,
the second pivot being disposed on a lower side of the first pivot; and
a hose guide disposed on a side surface of the lift link,
wherein
the boom swings upward and downward centering around the first pivot,
the hydraulic hose is disposed along the side surface of the lift link through the hose guide.

3. The working machine according to claim 1, further comprising:
a hydraulic coupler,
wherein
the boom has an upper surface, the upper surface facing upward,
the hydraulic coupler is disposed on a front end portion of the upper surface of the boom, and
an end portion of the hydraulic hose is withdrawn from the upper surface of the boom to be connected to the hydraulic coupler.

4. The working machine according to claim 1, further comprising:
a bucket disposed on a tip end portion of the boom;
a bucket cylinder configured to move the bucket;
a bucket cylinder pin configured to connect an upper end portion of the bucket cylinder to the boom;
a hydraulic coupler disposed on the boom; and
a hose outlet hole communicated with the hydraulic coupler and passing the hydraulic hose through the hose outlet hole, the hose outlet hole being disposed posterior to the bucket cylinder pin and opened upward.

5. The working machine according to claim 1, further comprising:
a lift link disposed on the boom base portion; and
a control link disposed anterior to the lift link to the boom base portion,
wherein
the lift link is pivotally supported by a first pivot on the boom base portion at one end portion of the lift link, the lift link is pivotally supported by a second pivot on the machine frame at the other end portion of the lift link,
the control link is pivotally supported by a third pivot on the machine frame at one end portion of the control link, the control link is pivotally supported by a fourth pivot on the boom base portion at the other end portion of the control link, and the boom swings upward and downward centering around the first pivot.

6. The working machine according to claim 1, further comprising:

a lift link disposed on the boom base portion, the lift link being inserted between an inner side wall and an outer side wall of the boom base portion at one end portion of the lift link, the lift link being pivotally supported by a first pivot on the boom base portion at the one end portion of the lift link, the lift link being pivotally supported by a second pivot on the machine frame at the other end portion of the lift link, the second pivot being arranged on a lower side of the first pivot, wherein the boom base portion includes the inner side wall, the outer side wall opposite to the inner side wall, an upper connection wall connecting upper portions of the inner side wall and the outer side wall, and a lower connection wall connecting lower portions opposite to the upper portions of the inner side wall and the outer side wall, the upper connection wall and the lower connection wall provide a space opened between rear portions thereof, the boom swings upward and downward centering around the first pivot, and a plurality of the hydraulic hoses pass through, in front of the first pivot, between the lift link and the inner side wall and between the lift link and the outer side wall, and are disposed inside the space opened between the rear portions of the upper connection wall and the lower connection wall.

7. The working machine according to claim 6, wherein a clearance between the lift link and the outer side wall is larger than a clearance between the lift link and the inner side wall, or the clearance between the lift link and the inner side wall is larger than the clearance between the lift link and the outer side wall.

8. The working machine according to claim 6, wherein a clearance between the lift link and the outer side wall is larger than a clearance between the lift link and the inner side wall, a plurality of the hydraulic hoses includes a first hydraulic hose and a second hydraulic hose having a diameter smaller than a diameter of the first hydraulic hose, the first hydraulic hose passes through between the lift link and the outer side wall, and the second hydraulic hose passes through between the lift link and the inner side wall.

9. A working machine comprising:

a machine frame;

an operator seat disposed on the machine frame;

a boom disposed on each side of the operator seat, the boom including a boom base portion disposed on a position corresponding to a rear portion of the machine frame, a boom tip end portion arranged opposite to the boom base portion, and a boom intermediate portion disposed between the boom base portion and the boom tip end portion;

a boom cylinder having one end connected to the boom base portion and another end connected to the machine frame, the boom cylinder being configured to swing the boom upward and downward; and a hydraulic hose extending into a rear portion or downward facing portion of the boom base portion and being disposed inside of the boom intermediate portion, the hydraulic hose being used for passage of an operation fluid.

10. The working machine according to claim 9, further comprising:

a lift link disposed on the boom base portion, the lift link being inserted between an inner side wall and an outer side wall of the boom base portion at one end portion of the lift link, the lift link being pivotally supported by a first pivot on the boom base portion at the one end portion of the lift link, the lift link being pivotally supported by a second pivot on the machine frame at the other end portion of the lift link, the second pivot being arranged on a lower side of the first pivot, wherein the boom base portion includes the inner side wall, the outer side wall opposite to the inner side wall, an upper connection wall connecting upper portions of the inner side wall and the outer side wall, and a lower connection wall connecting lower portions opposite to the upper portions of the inner side wall and the outer side wall, the upper connection wall and the lower connection wall provide a space opened backward or downward between rear portions thereof, the boom swings upward and downward centering around the first pivot, and a plurality of the hydraulic hoses pass through, in front of the first pivot, between the lift link and the inner side wall and between the lift link and the outer side wall, and are disposed inside the space opened backward or downward between the rear portion of the upper connection wall and the rear portion of the lower connection wall.

11. The working machine according to claim 10, wherein a clearance between the lift link and the outer side wall is larger than a clearance between the lift link and the inner side wall, or the clearance between the lift link and the inner side wall is larger than the clearance between the lift link and the outer side wall.

12. The working machine according to claim 10, wherein a clearance between the lift link and the outer side wall is larger than a clearance between the lift link and the inner side wall, a plurality of the hydraulic hoses includes a first hydraulic hose and a second hydraulic hose having a diameter smaller than a diameter of the first hydraulic hose, the first hydraulic hose passes through between the lift link and the outer side wall, and the second hydraulic hose passes through between the lift link and the inner side wall.

13. The working machine according to claim 9, further comprising:

a hydraulic coupler, wherein the boom has an upper surface, the upper surface facing upward, the hydraulic coupler is disposed on a front end portion of the upper surface of the boom, and an end portion of the hydraulic hose is withdrawn from the upper surface of the boom to be connected to the hydraulic coupler.

14. The working machine according to claim 9, further comprising:

a lift link disposed on the boom base portion, the lift link being pivotally supported by a first pivot on the boom base portion at one end portion of the lift link, the lift link being pivotally supported by a second pivot on the machine frame at the other end portion of the lift link, the second pivot being disposed on a lower side of the first pivot; and a hose guide disposed on a side surface of the lift link, wherein the boom swings upward and downward centering around the first pivot, the hydraulic hose is disposed along the side surface of the lift link through the hose guide.

15. The working machine according to claim 9, further comprising:

a bucket disposed on a tip end portion of the boom;

a bucket cylinder configured to move the bucket;

a bucket cylinder pin configured to connect an upper end portion of the bucket cylinder to the boom;

a hydraulic coupler disposed on the boom; and a hose outlet hole communicated with the hydraulic coupler and passing the hydraulic hose through the hose outlet hole, the hose outlet hole being disposed posterior to the bucket cylinder pin and opened upward.

16. The working machine according to claim 9, further comprising:

a lift link disposed on the boom base portion; and a control link disposed anterior to the lift link to the boom base portion, wherein the lift link is pivotally supported by a first pivot on the boom base portion at one end portion of the lift link, the lift link is pivotally supported by a second pivot on the machine frame at the other end portion of the lift link, the control link is pivotally supported by a third pivot on the machine frame at one end portion of the control link, the control link is pivotally supported by a fourth pivot on the boom base portion at the other end portion of the control link, and the boom swings upward and downward centering around the first pivot.

17. A working machine comprising:

a machine frame;

an operator seat disposed on the machine frame;

a boom disposed on each side of the operator seat, the boom including a boom base portion disposed on a position corresponding to a rear portion of the machine frame, a boom tip end portion arranged opposite the boom base portion, and a boom intermediate portion disposed between the boom base portion and the boom tip end portion;

a boom cylinder having one end connected to the boom base portion and another end connected to the machine frame, the boom cylinder being configured to swing the boom upward and downward;

a hose insertion hole disposed in the boom base portion, the hose insertion hole being opened backward or downward; and a hydraulic hose inserted into the hose insertion hole and disposed inside of the boom intermediate portion, the hydraulic hose being used for passage of an operation fluid.

18. The working machine according to claim 17, further comprising:

a lift link disposed on the boom base portion, the lift link being pivotally supported by a first pivot on the boom base portion at one end portion of the lift link, the lift link being pivotally supported by a second pivot on the machine frame at the other end portion of the lift link, the second pivot being disposed on a lower side of the first pivot; and a hose guide disposed on a side surface of the lift link, wherein the boom swings upward and downward centering around the first pivot, and the hydraulic hose is disposed along the side surface of the lift link through the hose guide.

19. The working machine according to claim 17, further comprising:

a lift link disposed on the boom base portion, the lift link being inserted between an inner side wall and an outer side wall of the boom base portion at one end portion of the lift link, the lift link being pivotally supported by a first pivot on the boom base portion at the one end portion of the lift link, the lift link being pivotally supported by a second pivot on the machine frame at the other end portion of the lift link, the second pivot being disposed on a lower side of the first pivot, wherein the boom base portion includes the inner side wall, the outer side wall opposite to the inner side wall, an upper connection wall connecting upper portions of the inner side wall and the outer side wall, and a lower connection wall connecting lower portions opposite to the upper portions of the inner side wall and the outer side wall, the hose insertion hole is formed of the inner side wall, the outer side wall, the upper connection wall, and the lower connection wall and is configured by opening between an end of a rear portion of the upper connection wall and an end of a rear portion of the lower connection wall, the boom swings upward and downward centering around the first pivot, and a plurality of the hydraulic hoses pass through between the lift link and the inner side wall and between the lift link or the outer side wall, and are disposed inside the hose insertion hole.

20. The working machine according to claim 19, wherein a clearance between the lift link and the outer side wall is larger than a clearance between the lift link and the inner side wall, or the clearance between the lift link and the inner side wall is larger than the clearance between the lift link and the outer side wall.

21. The working machine according to claim 19, wherein a clearance between the lift link and the outer side wall is larger than a clearance between the lift link and the inner side wall, a plurality of the hydraulic hoses includes a first hydraulic hose and a second hydraulic hose having a diameter smaller than a diameter of the first hydraulic hose, the first hydraulic hose passes through between the lift link and the outer side wall, and the second hydraulic hose passes through between the lift link and the inner side wall.

22. The working machine according to claim 17, further comprising:

a hydraulic coupler, wherein the boom has an upper surface, the upper surface facing upward, the hydraulic coupler is disposed on a front end portion of the upper surface of the boom, and an end portion of the hydraulic hose is withdrawn from the upper surface of the boom to be connected to the hydraulic coupler.

23. The working machine according to claim 17, further comprising:

a bucket disposed on a tip end portion of the boom;

a bucket cylinder configured to move the bucket;

a bucket cylinder pin configured to connect an upper end portion of the bucket cylinder to the boom;

a hydraulic coupler disposed on the boom; and a hose outlet hole communicated with the hydraulic coupler and passing the hydraulic hose through the hose outlet hole, the hose outlet hole being disposed posterior to the bucket cylinder pin and opened upward.

24. The working machine according to claim 17, further comprising:

a lift link disposed on the boom base portion; and a control link disposed anterior to the lift link to the boom base portion, wherein the lift link is pivotally supported by a first pivot on the boom base portion at one end portion of the lift link, the lift link is pivotally supported by a second pivot on the machine frame at the other end portion of the lift link, the control link is pivotally supported by a third pivot on the machine frame at one end portion of the control link, the control link is pivotally supported by a fourth pivot on the boom base portion at the other end portion of the control link, and the boom swings upward and downward centering around the first pivot.

* * * * *